US011858709B2

(12) United States Patent
Fiere et al.

(10) Patent No.: US 11,858,709 B2
(45) Date of Patent: Jan. 2, 2024

(54) CLOSURE ASSEMBLY COMPRISING A CAP WITH AN INTEGRATED TAMPER-EVIDENT RING MEMBER

(71) Applicant: Scholle IPN IP BV, SX Tilburg (NL)

(72) Inventors: Jeroen Pieter Fiere, 's-Gravendeel (NL); Johannes Wilhelmus Van Tuil, HD Tilburg (NL); Willem Jan Adriaan Oosterling, SL Loon Op Zand (NL); Frederik Adriaan Van Spronsen, PT Geldrop (NL)

(73) Assignee: Scholle IPN IP BV, Tilburg (NL)

( * ) Notice: Subject to any disclaimer, the term of this patent is extended or adjusted under 35 U.S.C. 154(b) by 465 days.

(21) Appl. No.: 17/273,716

(22) PCT Filed: Aug. 23, 2019

(86) PCT No.: PCT/NL2019/050543
§ 371 (c)(1),
(2) Date: Mar. 4, 2021

(87) PCT Pub. No.: WO2020/050712
PCT Pub. Date: Mar. 12, 2020

(65) Prior Publication Data

US 2021/0354896 A1 Nov. 18, 2021

(30) Foreign Application Priority Data

Sep. 7, 2018 (NL) ..... 2021578
Jul. 18, 2019 (NL) ..... 2023526

(51) Int. Cl.
*B65D 75/58* (2006.01)

(52) U.S. Cl.
CPC ..... *B65D 75/5883* (2013.01); *B65D 2401/30* (2020.05)

(58) Field of Classification Search
CPC ..... B65D 75/5883; B65D 2401/30; B65D 41/3428; B65D 41/3409
(Continued)

(56) References Cited

U.S. PATENT DOCUMENTS 5,373,954 A * 12/1994 Julian ..... B65D 41/3409 215/256
6,439,429 B1 8/2002 Gross
(Continued)

FOREIGN PATENT DOCUMENTS

WO 2017/135824 A1 8/2017

*Primary Examiner* — Rafael A Ortiz
*Assistant Examiner* — Sanjidul Islam
(74) *Attorney, Agent, or Firm* — Jovan N. Jovanovic; The Watson IP Group, PLC

(57) ABSTRACT

A closure assembly comprises an article (10, 10', 10'', 10) and a cap (40, 40', 40'', 40''', 440) provided with an integrated tamper-evident ring member (50, 50', 50'', 450). The article further comprises a circumferential flange structure (20) with an annular flange portion and a peripheral protective rim portion (25) so that the top face (21*a*) of the flange portion and the protective rim define an annular recess (30) around the neck (14). The tamper-evident ring member is integrally formed to the lower edge of the skirt (42) of the cap via one or more breakable bridges (70). The ring member comprises an annular ring member flange portion (51) that has a top face (51*a*) and a bottom face (51*b*). Multiple hook members (53) are integrally formed to the bottom of the ring member flange portion, and the annular flange portion on the neck is provided with multiple hook member passages (1S). Each hook member passage is adapted to receive a hook member when the cap with the integrated tamper-evident ring member is axially mounted on the neck by means of an axial securing motion, wherein the hook portion (55) of each hook member snaps underneath the bottom face (21*b*) of the annular flange portion on
(Continued)

Figure 1:
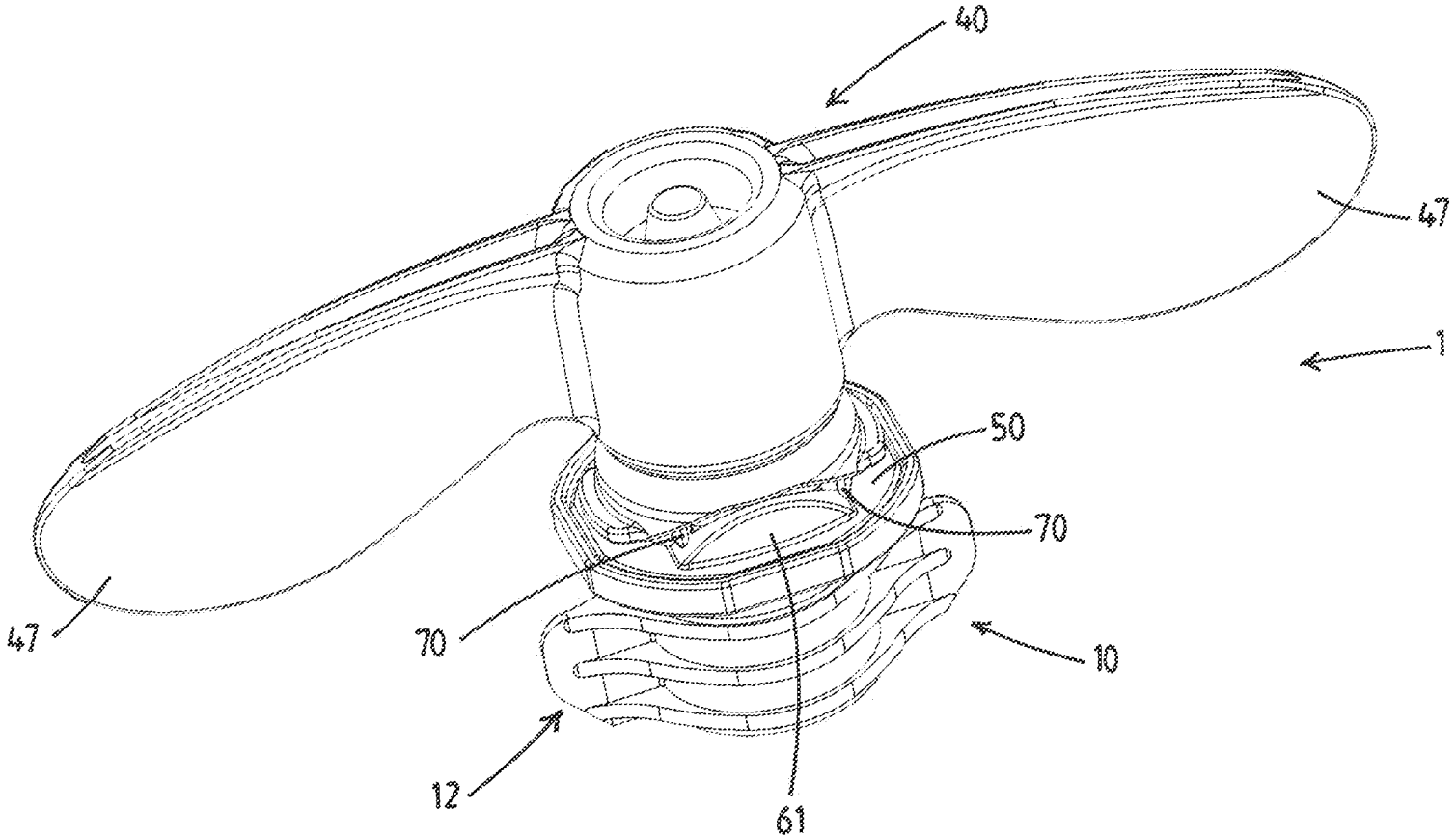

the neck of the article. The periphery of the annular flange portion of the ring member is shaped to fit within the protective rim portion and the rim portion obstructs lateral access from outside to the interface between flange portions.

20 Claims, 35 Drawing Sheets

(58) Field of Classification Search
USPC ..... 215/252, 228, 225, 224, 254.8, 254.1, 215/254.7
See application file for complete search history.

(56) References Cited

U.S. PATENT DOCUMENTS

2015/0374153 A1* 12/2015 Van Der Molen ..... B29D 99/0096 264/232
2016/0122095 A1* 5/2016 Berge ..... B65D 47/12 222/566
2017/0066571 A1* 3/2017 Panec ..... B65D 47/122

* cited by examiner

CLOSURE ASSEMBLY COMPRISING A CAP WITH AN INTEGRATED TAMPER-EVIDENT RING MEMBER

The present invention relates to a closure assembly, a container provided with the closure assembly, and to a method for producing filled containers provided with the closure assembly.

Closure assemblies are known with a plastic cap that can be removed by a user through a rotational movement from a neck, e.g. the neck of a plastic container with integrally molded neck or the neck of a spout that has been fitted on a collapsible pouch container.

In manufacturing a closure assembly, a tamper-evident structure is often integrally molded as a part of the plastic cap. Examples of such closure assemblies are shown in WO2014/007612, WO2012/044166, EP2380820, and GB 2492586.

In WO2017/135824 a closure assembly is disclosed wherein a tamper-evident ring is provided to the lower edge of the skirt of the cap. This ring comprises an annular base portion which is connected via one or more breakable bridges to the skirt. Embodiments are disclosed wherein a snap portion is located on one or both of the outer face and the inner face of the annular base portion. In an example, a snap portion located in the outer face of the annular base portion snaps into a window that is provided in a circumferential wall of a structure that is integral with the neck of the spout. The snap portion blocks an axial movement of the base portion with respect to the neck, such that a once snapped tamper-evident ring remains on the article and such that the bridges break when the user rotates the cap. The presence of the circumferential wall provides a shield that shields the tamper-evident ring that has been introduced in the inner space between the neck and the circumferential wall of the article. This reduces a risk of an undesired release of the tamper-evident ring once the cap has been removed. The wall around the tamper-evident ring may make it more difficult to loosen the tamper-evident ring by an act from the outside, like for example releasing the ring by nibbling on the neck of an opened closure.

The present invention aims to provide an improved closure assembly, or at least aims to provide an alternative for known closure assemblies. In particular, the invention aims to allow for a reduction of the use of plastic material, while maintaining or even enhancing the strength of the connection between the tamper-evident ring and the article.

According to a first aspect thereof the present invention achieves one or more of the above-mentioned objects by providing a closure assembly according to claim 1.

Herein the integrated tamper-evident ring member is embodied with the annular ring member flange portion and with the multiple hook members that are integrally formed to the bottom of the ring member flange portion. These hook members are distributed in a circumferential direction of the ring member flange portion. Each hook member comprises a leg having an upper end integral with the ring member flange portion and protruding downward from the ring member flange portion. Each hook member comprises a hook portion at the lower free end of the leg.

The annular flange portion on the neck of the article is provided with multiple hook member passages that each extend between the top face and the bottom face through the annular flange portion. Each hook member passage is adapted to receive a hook member when the cap with the integrated tamper-evident ring member is axially mounted, e.g. by a capping device, e.g. after filling of a container provided with the article, on the neck by means of an axial securing motion along the main axis of the neck. Herein the hook portion of each hook member engages, e.g. snaps, underneath the bottom face of the annular flange portion on the neck of the article.

The periphery of the annular flange portion of the ring member is shaped to fit within the protective rim portion as the annular flange portion is at least partially, preferably entirely, inserted in the annular recess upon axially mounting of the cap with the integrated tamper-evident ring member on the neck. Herein the peripheral protective rim, which is preferably devoid of any openings therein, is adapted to obstruct lateral access from outside to the interface between the top face of the flange portion of the article and the bottom face of the flange portion of the ring member.

Through the first aspect inventive design, a strong connection can be achieved between the tamper-evident ring on the one hand and the article on the other hand, using little plastic material for both components.

For example, the protective rim can be designed with a reduced height compared to the circumferential wall of the embodiments shown in WO2017135824 as a pull force on the ring member in attempt to pull of the ring member is, at least predominantly, absorbed by the downward protruding hook members and the flange portion on the neck of the article.

The protective rim does, at least to a degree, have the additional effect that it adds to the stability of the flange portion on the neck of the article and thus contributes to the resistance to a pull force on the ring member.

As indicated the protective rim is, preferably, devoid of any openings therein, which enhances the protective effect, strengthens the structure and interconnection of the components, and is beneficial in view of injection molding the article.

In an embodiment, the protective rim portion has a height such that, in the secured position of the cap provided with the integrated tamper-evident ring member, an outer annular zone of the top face of the flange portion thereof does not protrude above the protective rim portion. Preferably, this outer annular zone of the top face is located lower than the top of the rim portion. Hereby lateral access to the ring member is even further obstructed, thus reducing the practical possibility to exert a force thereon that would pull the ring member off the neck of the article.

In an embodiment, the hook member passages are located directly adjoining the neck.

In an embodiment, the legs of the hook members each have an inner leg face, this inner leg face adjoining the inner face of the flange portion of the ring member. This effectively locates the hook members closely adjacent the exterior of the neck, which is found effective when it comes to providing retention strength for the ring member using little plastic material compared to a location of the hook members further outward relative to the neck of the article.

In practical embodiments, the hook portion protrudes outwardly and away from the neck.

In an alternative design, the hook portion could protrude from the leg in a circumferential or tangential, direction relative to the neck.

In an embodiment, a hook member has two legs, or a single leg forked at its lower end, wherein each of said legs, or each forked end, has a corresponding hook portion. For example, an inverted V-shaped hook member is envisaged with two legs, or a forked leg. The legs or forked lower ends are then preferably located in an arrangement that is tangential or relative to the main axis, e.g. with the associated hook portions protruding in opposed tangential directions.

In an embodiment, the leg of at least one hook member, e.g. of all hook members, has an inner bevel face at the lower end thereof, e.g. at a junction of an inner leg face and a lower end face of the leg. Herein the neck is integrally formed with a corresponding bevel faced boss at a location below the corresponding hook member passage, such that upon axially mounting the cap with the integrated tamper-evident ring member on the neck by means of said axial securing motion along the main axis, the bevelled face of the boss contacts the inner bevel face of the leg and thereby assists in keeping the hook portion of the hook member engaged, e.g. snapped, underneath the bottom face of the annular flange portion on the neck of the article. This embodiment is most practical when the hook portion is directed outward, away from the neck.

In an embodiment, the outer periphery of the annular flange portion of the ring member and the inner periphery of the protective rim portion are shaped non-circular, e.g. thereby providing enhanced resistance against the ring member being rotated along with the cap upon first time opening of the closure.

In an embodiment, e.g. preferably combined with the feature discussed in the preceding paragraph, the outside of the protective rim provides at least one pair of opposed parallel side faces, preferably two pairs that are orthogonal to one another, e.g. the protective rim being four-sided preferably with rounded corner faces. This embodiment e.g. allows for the parallel side face pairs to be used in the course of guidance of the article, e.g. of a pouch provided with a spout embodied like this, in a production and/or filling line. Having two orthogonal pairs of such parallel side faces e.g. allows for guidance in two orthogonal directions, e.g. in a pouch manufacturing line along one direction, and in a filling line of pouches directly downstream thereof in another, orthogonal direction. It will be appreciated that the inside of the protective rim, preferably also the periphery of the flange portion of the ring member, may have the same design.

In an embodiment, the upper face of the flange portion on the neck of the article is substantially planar, preferably radial to the main axis, wherein the bottom face of the ring member flange portion is substantially planar, preferably radial to the main axis. Thereby the interface between these flange portions is in a plane that is preferably radial or perpendicular to the main axis, in other words in this context horizontal.

In an embodiment these faces of the flange portions are flat and smooth, in another embodiment these faces have mating reliefs, e.g. ribs and grooves, to provide an axial form locking engagement of these faces that, e.g., counters any torque on the ring member about the main axis (e.g. upon first time opening of the cap). This embodiment, with axially mating relief on these faces may, e.g. be combined with a circular periphery of the flange portions and of the protective rim.

In yet another embodiment, of which an example is also illustrated in the drawings, the upper face of the flange portion of on the neck of the article is saddle shaped with two diametrically opposed downwardly curved upper face zones, wherein the bottom face of the ring member flange portion is complementary saddle shaped. Preferably, these flange portions also have their other, bottom or upper, face saddle shaped, so that these flange portions are saddle shaped in form. Herein, as preferred, the cap is a quarter turn opening cap, and the saddle shape of the flange portion of the ring member cooperates with a complementary shaped lower edge of the skirt to provide a lift effect of the cap upon turning the cap by the user. This lift effect is preferably applied to release cooperating snap retention formations on the neck and on the skirt of the cap.

In a preferred embodiment, the closure assembly comprises a snap-on type cap providing in use of the closure assembly a snap-on functionality, wherein the interior side of the skirt of the cap and the exterior side of the neck of the article have co-operating snap connector formations, e.g. formed by first and second snap ridges, to provide the snap-on functionality. For example the neck is provided, axially spaced from the circumferential flange structure, with a series of snap ridge segments that are circumferentially spaced from one another, e.g. in combination with a circumferentially continuous snap ridge inside the skirt of the cap. For example, the cap can be replaced on the neck after first time opening, with the snap features then properly retaining the cap on the neck.

For example, the neck has a smooth, e.g. mainly cylindrical, exterior, at least in the region between any snap-on ridge and the mouth, preferably also between any snap-on ridge on the circumferential flange structure. Such a smooth design is, for example, advantageous if the neck is designed to be placed between the lips of a consumer for drinking a product out of a container provided with the closure assembly.

In an embodiment, the skirt of the cap on the one hand and the circumferential flange structure of the article on the other hand have co-operating snap connector formations to provide the snap-on functionality. For example, the peripheral protective rim portion on the one hand and the exterior side of the skirt of the cap on the other hand have co-operating snap connector formations, e.g. the rim portion having a recess or window and the skirt being provided with a latching tab that is snapped into said recess or window in the closed position of the cap, so upon removal of the cap the tab becomes unsnapped and released from the window or recess. In a practical embodiment, the peripheral protective rim is provided with at least one upwardly protruding latch wall portion having a window or recess therein and the exterior side of the skirt is provided with a latching tab that is snapped into said window or recess in the closed position of the cap.

In an embodiment, preferably with a snap-on type cap, the closure assembly comprises:

- at least one first cam portion defining a cam surface, which cam surface is angled with respect to the main axis, which first cam portion is integrally formed on one of the lower edge of the skirt and the flange portion of the tamper-evident ring member, and
- at least one second cam portion defining a cam follower surface adapted to interact with the cam surface of the first cam portion and which second cam portion is integrally formed on the other one of the lower edge of the skirt and the flange portion of the tamper-evident ring member, wherein—upon first time opening of the closure assembly by rotation of the cap relative to the article about the main axis—the first and second cam portions interact in order to cause, practically immediately upon turning the cap, an axial lifting of the cap relative to the neck, so upward, e.g. so that the co-operating snap connector formations disengage due to said lifting.

In a practically preferred embodiment, the cap is a quarter-turn opening snap-on type cap, so that rotating the cap over about a quarter turn causes sufficient lift to disengage the snap retention of the cap and, also, break the breakable bridges. Depending on the design of the first cam portion and the second cam portion the cap may be rotatable about the neck for opening the closure in both directions, so clockwise and counter clockwise, or the design may be such that the cap is rotatable in just one direction, e.g. only clockwise.

In a practically preferred embodiment, a pair of first cam portions, preferably a single pair only, is integrally formed at the top face of the ring member flange portion, at diametrically opposed locations, wherein a pair of second cam portions is integrally formed at the lower end of the skirt, at diametrically opposed locations. In a practical embodiment, the first cam portions extend in part above the height of the protective rim, so that their presence is well visible enhancing the understanding by a user of the closure assembly.

In an embodiment, the first cam portion has an arched first cam surface with a centre raised higher than the top face of the flange portion and with a first and second ends where the arched first cam surface adjoins the top face of the flange portion. Hereby the arched first cam surface provides two oppositely inclined slopes allowing for opening of the closure by rotation of the cap in either direction about the neck, so clockwise and counter clockwise, when the second cam portion has a correspondingly shaped, e.g. arched, cam follower surface. In an embodiment hereof, a breakable bridge is present at each of said first and second ends of the upwardly arched first cam surface. The arched first cam surface may have a flattened centre, and/or the arc need not have a constant radius.

In a practical embodiment, the second cam portion is at least in part formed by a complementary section, e.g. arched, curved, polygonal, of the lower end of the skirt of the cap, e.g. an upwardly arched section of the lower end that is located just above the arched first cam surface with a centre raised relative to the flange portion of the ring member, wherein the breakable bridges initially maintain said arrangement.

In another embodiment, the at least one first cam portion defines a cam surface that is functional only when rotating the cap in clockwise direction, e.g. with the first came portion also defining a stop face, e.g. vertical or nearly vertical, for the cap that cooperates with a stop face on the skirt of the cap when attempting to rotate the cap in counter clockwise direction.

In a practical embodiment, e.g. in combination with the feature of the preceding paragraph, the cap comprises an outwardly extending tab integrally formed at the lower end of the skirt and adapted to cooperate with the first cam surface, preferably the cap having two diametrically opposed tabs. Therefore, the cap may have a lower skirt edge with two upwardly arched sections at diametrically opposed locations and in addition a pair of outwardly extending tabs, each tab located at the section of the lower skirt edge between the upwardly arched sections.

In an embodiment, the cap has a pair of wing-shaped handles generally extending in an imaginary plane through the main axis of the neck, and the cam portions of the pair of first cam portions are located on diametrically opposed locations to the neck and extend each transverse to said imaginary plane. In an embodiment, the cap comprises two tabs extending outwardly from the skirt, e.g. horizontally extending tabs, wherein said two tabs are located opposite from one another relative to said imaginary plane.

In an embodiment, in order to enhance grip on the cap and/or to enhance anti-choke properties of the cap, the cap has two diametrically opposed, substantially planar wing portions that extend outwardly from the skirt in an imaginary vertical plane through the main axis the neck.

In an embodiment, the pair of first ramp portions are located on diametrically opposed locations relative to the imaginary vertical plane through the wing portions of the cap. This is effective in view of injection molding and of strength of the cap and integrated tamper-evident ring member.

In an embodiment, at least one pair of hook members and corresponding hook member passages is located on diametrically opposite locations relative to the neck and in the imaginary vertical plane through the wing portions of the cap. Effectively these hook members are then underneath the wing members and, in a practical embodiment, above the top edge of a pouch, which top edge is aligned with the wing portions when the cap with integrated ring member is secured on the neck. This location renders these hook members effective when it comes to resisting removal of the ring member from the neck. In an embodiment at least one hook member, preferably two hook members, and corresponding hook member passages are located on diametrically opposed locations relative to the imaginary vertical plane through the wing portions of the cap.

In a practically preferred embodiment, there are six hook members and corresponding hook member passages. For example, the neck of such assembly has an external diameter between 7 and 15 millimeters. In another embodiment there are four hook members and corresponding hook member passages, e.g. two groups of two hook members at opposite locations relative to a vertical plane through a main axis of the cap.

In an embodiment, the cap has an annular top wall having an inner perimeter and an outer perimeter, wherein the downward depending skirt is integral with the outer perimeter, and wherein a hollow pin portion depends from the inner perimeter, the hollow pin portion having a circumferential face extending along a length thereof and a closed pin bottom, e.g. the hollow pin portion being open at a top thereof, wherein the circumferential face of the hollow pin portion and the article have at least one pair of cooperating sealing surfaces such that hollow pin portion, in the closed position cap, closes the product passage. Preferably, the hollow pin portion extends from the annular top wall downward at least to the level of the tamper-evident ring member, preferably further downward.

In an embodiment, the cap has at least one handle, e.g. a wing shaped handle, extending outwardly from the skirt and configured to be engaged by the user for opening of the assembly. For example, the cap is provided with a pair of oppositely extending wing shaped handles.

In an embodiment, each handle has a panel portion and at least one reinforcing top protrusion that is integral with the panel portion along at least a part of the top side of the handle. This at least one top protrusion reinforces the handle, e.g. allowing for the panel portion to be relatively thin and thereby saving plastic material. Each top protrusion protrudes away from the face of the panel portion, that is for example vertical or near vertical, in a direction substantially in or opposed to the opening direction of the cap.

In an embodiment, the handle has two diverging top protrusions that extend inclined upward from the panel portion at the top side and which diverge from one another defining a Y-shaped vertical cross-section of the wing shaped handle together with the panel portion. In alternative embodiments, each handle could have one top protrusion, e.g. defining an inverted L-shaped cross-section together with the panel portion. Alternatively, in yet another embodiment, each handle could have two oppositely directed top protrusions defining with the panel portion a T-shaped cross-section of the handle.

In an embodiment, the article is a fitment to be secured or secured to a container body. For example the article is a spout, e.g. having a lower connector portion, e.g. a seal boat portion, adapted to be secured or secured between opposed film walls of a collapsible pouch container or having a lower circumferential flange or plate portion to be secured or secured onto a panel of a container, e.g. a panel of a carton or a wall of a collapsible pouch.

In an embodiment, the article is a spout which comprises a lower connector portion secured or to be secured, e.g. by heat sealing, between opposed film walls of a collapsible pouch container, e.g. wherein the lower connector portion is a seal boat.

The present invention also relates to a container provided with a closure assembly as described herein, e.g. a collapsible pouch container.

The present invention also relates to a method for manufacturing a pre-assembled closure assembly as described herein for later mounting thereof as a unit on a container, the method comprising:

making, e.g. moulding, e.g. injection moulding, the article of plastic material, — making, e.g. moulding, e.g. injection moulding, the cap provided with an integrated temper-evident ring member, securing the cap and integrated tamper-evident ring member onto the neck of the article by means of an axial securing motion along the main axis such that the cap seals the product passage, wherein the hook members enter into and through the respective hook member passages and their hook portions snap underneath the bottom face of the annular flange portion on the neck, wherein the flange portion of the ring member is at least partially inserted in the annular recess.

The present invention also relates to a method for manufacturing and filling a container, comprising the steps of:

providing a container having the article thereon without the cap and integrated tamper-evident ring member, filling the container e.g. via the product passage in the article, securing the cap and integrated tamper-evident ring member onto the neck of the article by means of an axial securing motion along the main axis such that the cap seals the product passage, wherein the hook members enter into and through the respective hook member passages and their hook portions snap underneath the bottom face of the annular flange portion on the neck, and wherein the flange portion of the ring member is at least partially inserted in the annular recess.

The present invention also relates to a method for manufacturing and filling a container, said method comprising the steps of:

providing a container having an article mounting location, e.g. an opening, e.g. an opening in a top edge or seam of a pouch packing, adapted to mount the article with the cap and integrated tamper-evident ring member of the type discussed herein on the container, filling the container, e.g. via the opening, mounting an assembly of the article and cap including the integrated tamper-evident ring member as a unit on the container at the article mounting location.

A second aspect of the invention relates to a closure assembly comprising an article and comprising a cap provided with an integrated tamper-evident ring member wherein:

the article forms a tubular neck around a product passage in said article, said neck having a main axis and forming a mouth at a top end of said product passage, wherein the article further comprises a circumferential flange structure which comprises an annular flange portion that is integrally formed to the neck and extends around the neck, which flange portion has a top face, a bottom face, and a periphery, the cap provided with an integrated tamper-evident ring member is adapted to be secured or is secured on said neck of the article by means of an axial securing motion along the main axis, wherein the cap comprises a skirt, said skirt having an interior side, an exterior side, and a lower edge remote from the top wall structure, wherein the cap is adapted to seal the product passage in a closed position of the cap on said neck, and wherein the cap is adapted to be manually removed from the neck of the article by a user to open the product passage, wherein the tamper-evident ring member is integrally formed to the lower edge of the skirt of the cap and connected to said lower edge via one or more breakable bridges, wherein the tamper-evident ring member comprises an annular ring member flange portion that has a top face, a bottom face, an inner face, and an outer face, wherein multiple hook members are integrally formed to the bottom of the ring member flange portion, the hook members being distributed in a circumferential direction of the ring member flange portion, wherein each hook member comprises a leg having an upper end integral with the ring member flange portion and protruding downward from the ring member flange portion, wherein each hook member comprises a hook portion at the lower free end of the leg, wherein the annular flange portion on the neck of the article is provided with multiple hook member passages that each extend between the top face and the bottom face through said annular flange portion, each hook member passage being adapted to receive a hook member when the cap with the integrated tamper-evident ring member is axially mounted on the neck by means of said axial securing motion along the main axis, wherein the hook portion of each hook member engages underneath the bottom face of the annular flange portion on the neck of the article, and wherein the closure assembly is embodied such that upon first time opening of the closure assembly by removal of the cap by a user the one or more breakable bridges break and the ring member is retained by means of the hook members.

As explained with reference to the first aspect of the invention the closure assembly according to the second aspect of the invention allows to achieve, in embodiments, a strong connection of the ring member to the article. Optionally, the rim portion of the first aspect of the invention is provided. Optionally, the periphery of the annular flange portion of the ring member is shaped to fit within the protective rim portion as the annular flange portion is at least partially inserted in an annular recess upon said axially mounting of the cap with the integrated tamper-evident ring member on the neck. Preferably, the peripheral protective rim portion is adapted to obstruct lateral access from outside to the interface between the top face of the flange portion of the article and the bottom face of the flange portion of the ring member.

It will be appreciated that the closure assembly of the second aspect of the invention may be enhanced by one or more features discussed herein with reference to the first aspect of the invention.

A third aspect of the present invention relates to a closure assembly comprising an article and comprising a plastic cap provided with an integrated tamper-evident ring member, wherein:

the article forms a tubular neck around a product passage in said article, said neck having a main axis and forming a mouth at a top end of said product passage, wherein the article further comprises a flange structure which comprises a flange portion that is integrally formed to the neck, which flange portion has a top face, a bottom face, the plastic cap provided with an integrated tamper-evident ring member is adapted to be secured or is secured on said neck of the article by means of an axial securing motion along the main axis, wherein the cap comprises a downward depending skirt, said skirt having an interior side, an exterior side, and a lower edge remote from the top wall structure, wherein the cap is adapted to seal the product passage in a closed position of the cap on said neck, and wherein the cap is adapted to be manually removed from the neck of the article by a user to open the product passage, wherein the tamper-evident ring member is integrally formed to the skirt of the cap and connected to said skirt via one or more breakable bridges, wherein the tamper-evident ring member comprises an annular ring member portion that has a bottom face, an inner face, and an outer face, wherein multiple hook members are integrally formed to the bottom of the ring member portion, the hook members being distributed in a circumferential direction of the ring member portion, wherein each hook member comprises a leg having an upper end integral with the ring member portion and protruding downward from the ring member flange portion, wherein each hook member comprises a hook portion at the lower free end of the leg, wherein the flange structure on the neck of the article is provided with multiple hook member passages that each extend between the top face and the bottom face through said flange portion thereof, each hook member passage being adapted to receive a hook member when the cap with the integrated tamper-evident ring member is axially mounted on the neck by means of said axial securing motion along the main axis, wherein the hook portion of each hook member engages, e.g. snaps, underneath the bottom face of the flange portion on the neck of the article, and wherein the closure assembly is embodied such that upon first time opening of the closure assembly by removal of the cap by a user the one or more breakable bridges break and the ring member is retained on the article by means of the hook members.

As explained with reference to the first aspect of the invention the closure assembly according to the third aspect of the invention allows to achieve, in embodiments, a strong connection of the ring member to the article. Optionally, the flange structure on the neck comprises an annular flange portion. In an alternative, two separate flange portions are provided in a common plane at diametrically opposed locations relative to the neck. Optionally, the rim portion of the first aspect of the invention is provided. Optionally, the ring member has a flange portion, e.g. an annular flange portion. Optionally, the periphery of the annular flange portion of the ring member is shaped to fit within the protective rim portion as the annular flange portion is at least partially inserted in an annular recess upon said axially mounting of the cap with the integrated tamper-evident ring member on the neck.

It will be appreciated that the closure assembly of the third aspect of the invention may be enhanced or complemented by one or more features discussed or disclosed herein with reference to any of the other aspects of the invention.

A fourth aspect of the present invention relates to a closure assembly comprising an article and comprising a cap provided with an integrated tamper-evident ring member wherein:

the article forms a tubular neck around a product passage in said article, said neck having a main axis and forming a mouth at a top end of said product passage, wherein the article further comprises a flange structure which is integrally formed to the neck and comprises one or more flange portions having a top face, a bottom face, and a periphery, the cap provided with an integrated tamper-evident ring member is adapted to be secured or is secured on said neck of the article by means of an axial securing motion along the main axis, wherein the cap comprises a skirt, said skirt having an interior side, an exterior side, and a lower edge remote from the top wall structure, wherein the cap is adapted to seal the product passage in a closed position of the cap on said neck, and wherein the cap is adapted to be manually removed from the neck of the article by a user to open the product passage, wherein the tamper-evident ring member is integrally formed to the skirt of the cap and connected to the skirt via one or more breakable bridges, wherein the tamper-evident ring member comprises multiple hook members, for example wherein the ring member comprises an annular ring member flange portion that has a top face, a bottom face, an inner face, and an outer face, wherein said multiple hook members are integrally formed to the ring member flange portion, the hook members being distributed in a circumferential direction of the ring member flange portion, wherein the flange structure on the neck of the article is provided with multiple hook member passages, each hook member passage being adapted to receive therein a hook member when the cap with the integrated tamper-evident ring member is axially mounted on the neck by means of said axial securing motion along the main axis, wherein a hook portion of each hook member snap onto the flange structure, wherein the article on the one hand and the cap on the other hand have co-operating snap connector formations to provide a snap-on functionality of the cap so that the cap can be replaced on the neck after first time opening, and wherein the closure assembly is embodied such that upon first time opening of the closure assembly by removal of the cap by a user the one or more breakable bridges break and the tamper-evident ring member is retained by means of the hook members, and wherein the removed cap is later replaceable on the neck with the co-operating snap connector formations releasably retaining the cap onto the article.

The closure assembly according to the fourth aspect of the invention allows to achieve an effective axial mounting of the cap on the article, e.g. at high speed using a robotic assembly device, where a strong and reliable connection between the integrated tamper-evident ring member and the flange structure is obtained by means of the hook members and at the same time a re-usable and reliable snap-functionality is provided between the cap and the article.

In an embodiment an exterior of the tubular neck of the article and the interior side of the skirt are provided with said cooperating snap connector formations, e.g. formed by first and second snap ridges, to provide the snap-on functionality.

In an embodiment the article, e.g. a flange structure of the article, is provided with two latch members, e.g. two latch wall portions, at diametrically opposed locations relative to the neck of the article, e.g. each arranged at the perimeter of a circumferential flange that extends around the neck, and the cap is provided with two mating latch members, e.g. two latch tabs, at diametrically opposed locations, which latch members on the article and on the cap are configured to provide a releasable snap connection between the cap and the article. For example, the latch tabs on the cap are each configured to be received or are received in a corresponding recess or window in a latch wall portion of the article allowing to snap the cap onto the article, e.g. in said axial securing motion of the cap.

For example, a peripheral rim portion extending around the perimeter of a circumferential flange structure of the article on the one hand and the exterior side of the skirt of the cap having co-operating snap connector formations, e.g. the peripheral rim portion having a recess or window and the skirt being provided with a latching tab that is snapped into said recess or window in the closed position of the cap, so upon removal of the cap the tab becomes unsnapped and released from the window or recess.

In a practical embodiment a flange structure of the article, e.g. a peripheral rim thereof, is provided with at least one upwardly protruding latch wall portion having a window or recess therein and the exterior side of the skirt being provided with a latching tab that is snapped into said window or recess in the closed position of the cap.

For example, a peripheral rim portion of the flange structure on the one hand and the exterior side of the skirt of the cap having co-operating snap connector formations, e.g. the rim portion having a recess or window and the skirt being provided with a latching tab that is snapped into said recess or window in the closed position of the cap, so upon removal of the cap the tab becomes unsnapped and released from the window or recess.

In a practical embodiment, the rim of the flange structure is provided with at least one upwardly protruding latch wall portion having a window or recess therein and the exterior side of the skirt being provided with a latching tab that is snapped into said window or recess in the closed position of the cap.

In an embodiment of the fourth aspect of the invention, the closure assembly comprises:

at least one first cam portion defining a cam surface, which cam surface is angled with respect to the main axis, which first cam portion is integrally formed on one of the lower edge of the skirt and the tamper-evident ring member, and at least one second cam portion defining a cam follower surface adapted to interact with the cam surface of the first cam portion and which second cam portion is integrally formed on the other one of the lower edge of the skirt and the tamper-evident ring member, wherein—upon first time opening of the closure assembly by rotation of the cap relative to the article about a main axis—the first and second cam portions interact in order to cause, practically immediately upon turning the cap, an axial lifting of the cap relative to the neck, so upward, e.g. so that the co-operating snap connector formations disengage due to said lifting.

In a practically preferred embodiment of the fourth aspect of the invention, the cap is a quarter-turn snap-on type cap, so that rotating the cap over about a quarter turn causes sufficient lift to disengage the snap retention of the cap and, also, break the breakable bridges. Depending on the design of the first cam portion and the second cam portion the cap may be rotatable about the neck for opening the closure in both directions, so clockwise and counter clockwise, or the design may be such that the cap is rotatable in just one direction, e.g. only clockwise.

For example, a tab on the exterior of the skirt providing the snap-on functionality of the fourth aspect of the invention, also serves as a part of the second cam portion and is integrally formed at the lower end of the skirt, said dual functionality tab being adapted to cooperate—once released from the respective window or recess as the user turns the cap for opening—with the first cam surface.

For example, in the fourth aspect of the invention, the cap has two diametrically opposed tabs and the flange structure, e.g. a peripheral rim thereof, is provided with two upwardly protruding latch wall portions, each of them having a window or recess therein and wherein each of said pair of tabs is snapped into a corresponding window or recess in the closed position of the cap.

It will be appreciated that the closure assembly of the fourth aspect of the invention may be enhanced or complemented by one or more features discussed or disclosed herein with reference to any one or more of the other aspects of the invention.

A fifth aspect of the invention relates to a closure assembly comprising an article and a quarter turn lift cap, said cap including an integrated tamper-evident ring, wherein:

the article forms a tubular neck around a product passage in said article, said neck forming a mouth at a top end of said product passage, the quarter turn lift cap including the integrated tamper-evident ring is made, e.g. moulded, as one piece of a plastic material and distinct from the article, which cap is secured on or is adapted to be secured on said neck of the article, the cap being adapted to be manually removed from the neck of the article by a user to open the product passage, wherein the cap has a closed position and an open position, wherein in the closed position the cap is positioned on the neck and thereby seals the product passage, wherein in the open position the cap is removed from the neck, thereby leaving the product passage open, wherein the cap comprises a top wall structure and a downward depending skirt having an interior side, exterior side, and a lower edge remote from the top wall structure, wherein the tamper-evident ring is integrally formed to the lower edge of the skirt of the cap, said tamper-evident ring comprising a base portion, e.g. an annular base portion, which is connected via one or more breakable bridges to the skirt, wherein the cap is a snap-on type cap providing in use of the closure assembly a snap-on functionality, wherein the article and the cap are provided with cooperating snap connector formations to provide the snap-on functionality, wherein the closure assembly comprises:

at least one first cam portion defining a cam surface, which cam surface is angled with respect to a main axis, which first cam portion is integrally formed on the base portion of the tamper-evident ring, and at least one second cam portion defining a cam follower surface adapted to interact with the cam surface of the first cam portion and which second cam portion is integrally formed on the lower edge of the skirt, wherein—upon first time opening of the closure assembly by rotation of the cap relative to the article over at most a quarter turn about the main axis—the first and second cam portions interact in order to cause axial lifting of the cap relative to the neck, e.g. so that the co-operating snap connector formations disengage, wherein the base portion of the tamper-evident ring comprises one or more integrally formed hook members, and wherein the article comprises one or more hook member passages, each hook member passage being adapted to receive a hook member when the cap is secured on the neck, for example wherein the article is provided with an annular flange portion on the neck of the article and wherein a hook portion of each hook member engages, e.g. snaps, underneath a bottom face of said annular flange portion on the neck of the article.

In the arrangement of the fifth aspect of the invention the one or more hook members securely retain the base portion relative to the article, and contribute in absorbing forces exerted on the first cam portion during removal of the cap.

In an embodiment at least one hook member is arranged vertically below an upwardly directed first cam portion, for example one hook member is located below a central region of the upwardly directed first cam portion, e.g. two further hook members are located below a first and a second end of the upwardly directed first cam portion respectively.

It will be appreciated that the closure assembly of the fifth aspect of the invention may comprise one or more features discussed herein with reference to any other aspect of the invention, e.g. according to the first and/or the second and/or the third and/or fourth aspect of the invention.

Any of the aspects also relates to a container provided with the closure assembly.

Any of the aspects also relates to a method for manufacturing a pre-assembled closure assembly as described herein for later mounting thereof as a unit on a container, the method comprising:

making, e.g. moulding, e.g. injection moulding, the article, e.g. of plastic material, making, e.g. moulding, e.g. injection moulding, the cap provided with an integrated temper-evident ring member, e.g. of plastic material, securing the cap and integrated tamper-evident ring member onto the neck of the article by means of an axial securing motion along the main axis such that the cap seals the product passage.

Any of the aspects also relates to a method for manufacturing and filling a container, comprising the steps of:

providing a container having the article thereon without the cap and integrated tamper-evident ring member, filling the container e.g. via the product passage in the article, securing the cap and integrated tamper-evident ring member onto the neck of the article by means of an axial securing motion along the main axis such that the cap seals the product passage.

Any of the aspects also relates to a method for manufacturing and filling a container, said method comprising the steps of:

providing a container having an article mounting location, e.g. an opening, e.g. an opening in a top edge or seam of a pouch packing, adapted to mount the article with the cap and integrated tamper-evident ring member of the type discussed herein on the container, filling the container, e.g. via the opening, mounting an assembly of the article and cap including the integrated tamper-evident ring member as a unit on the container at the article mounting location.

Figure 2:
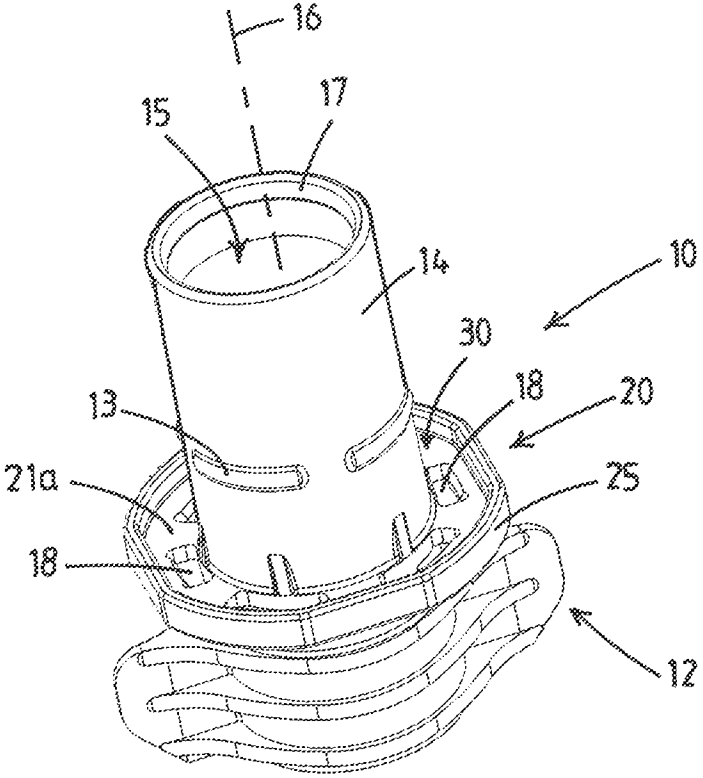
Figure 3:
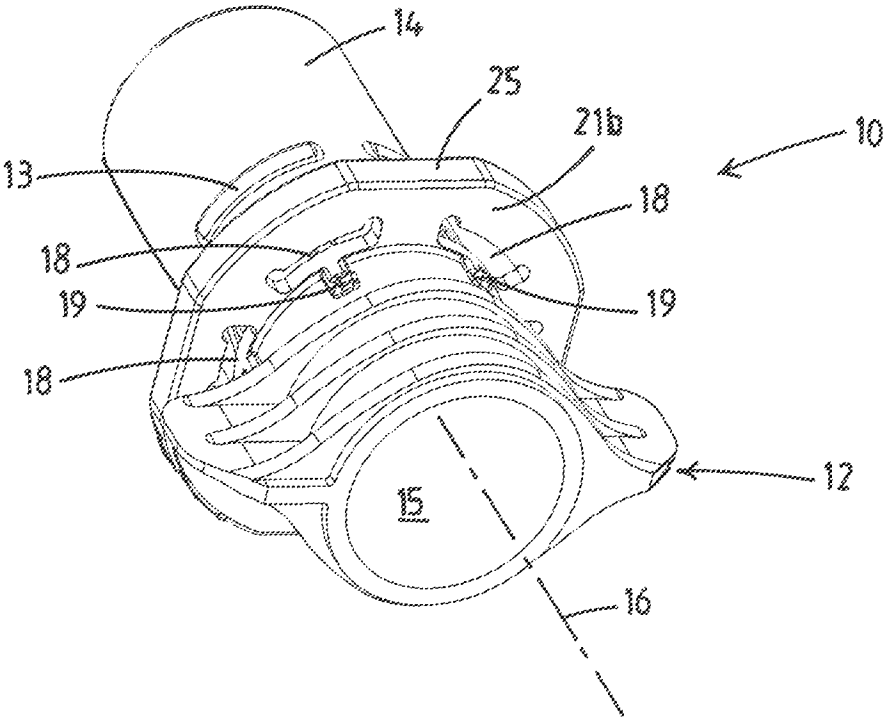
Figure 4:
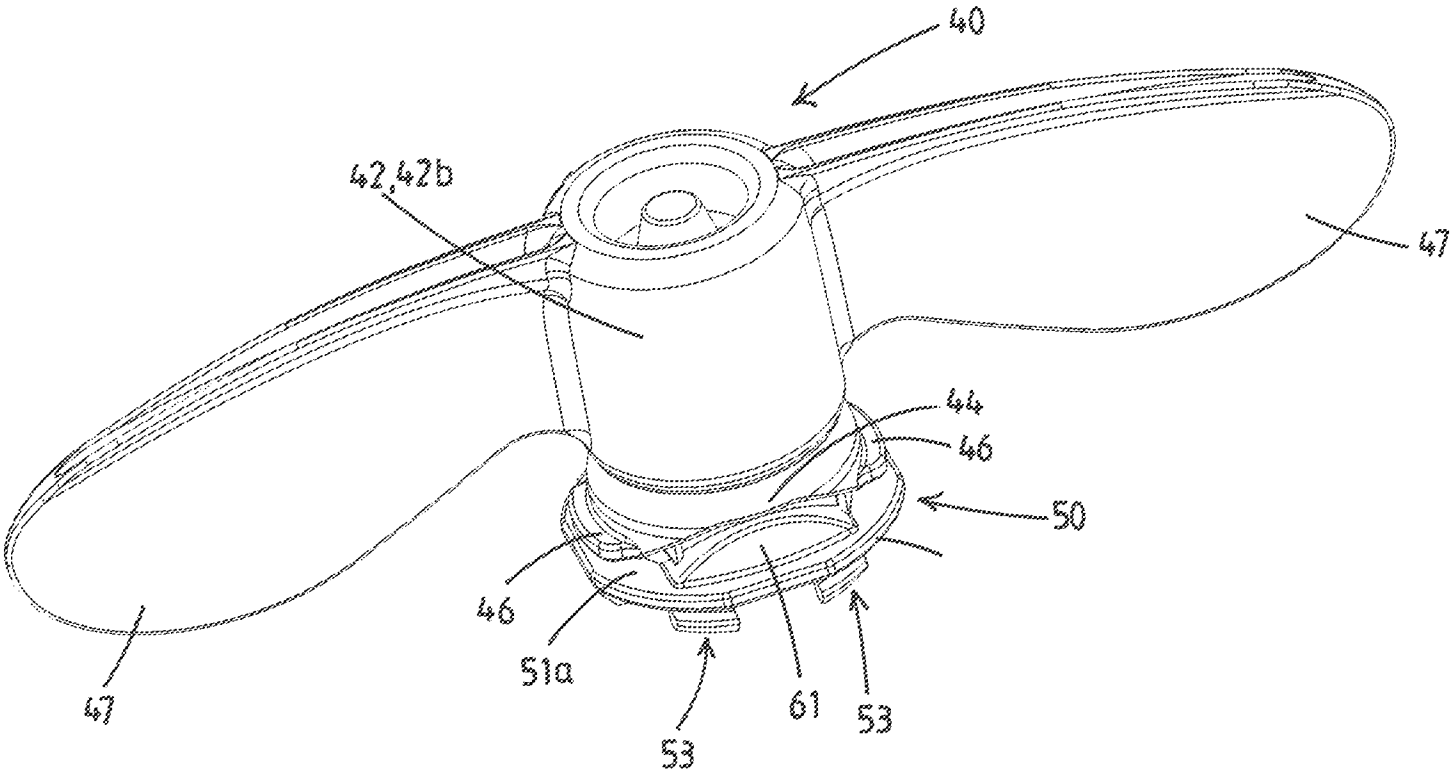
Figure 5:
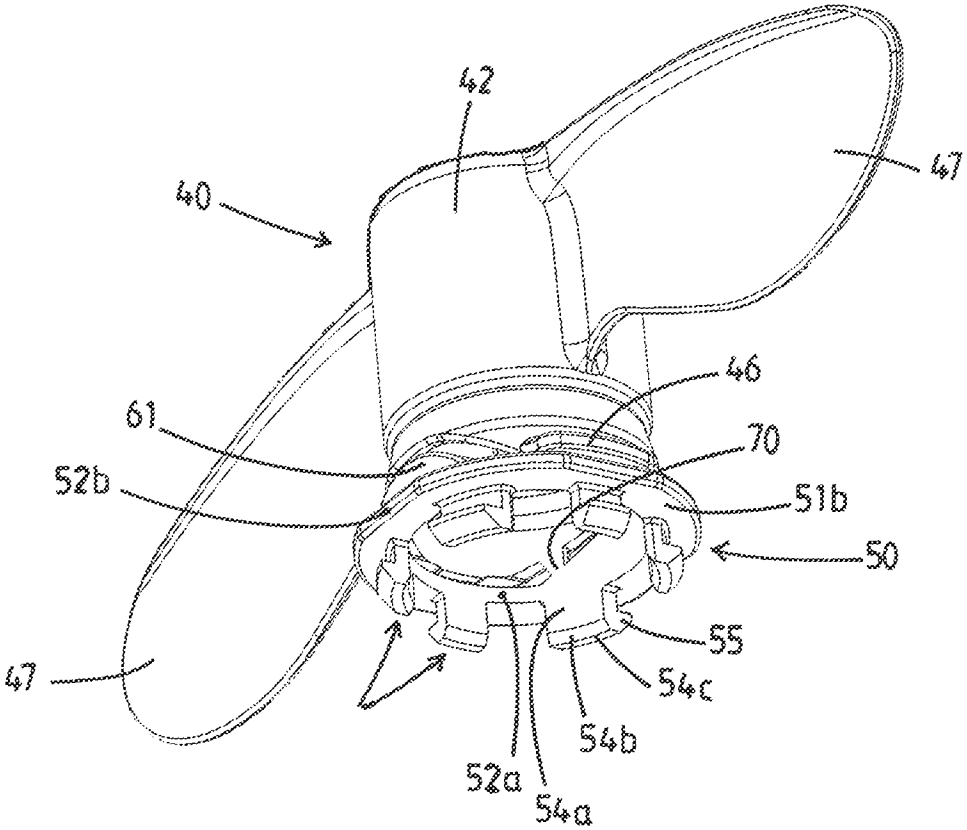
Figure 6:
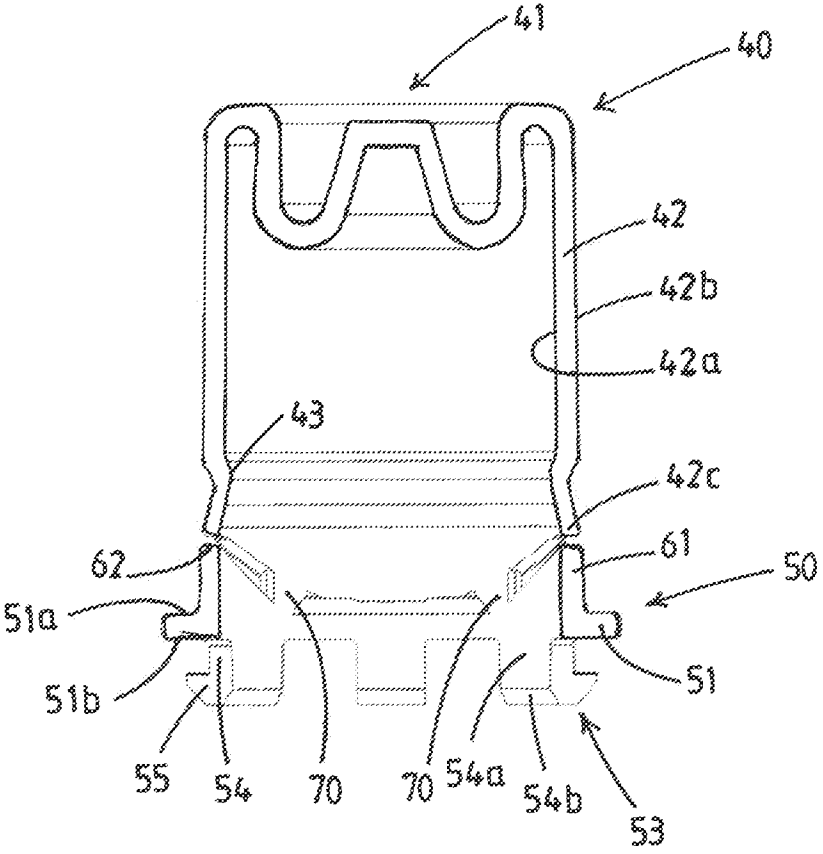
Figure 7:
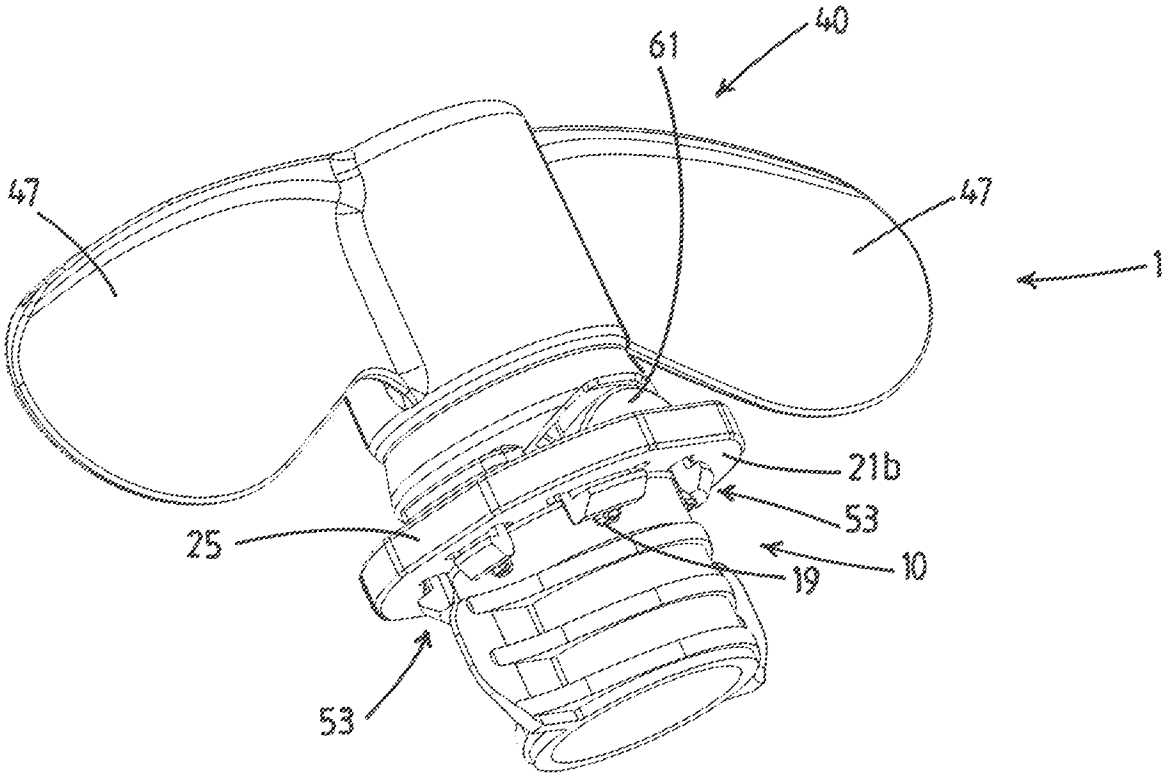
Figure 8:
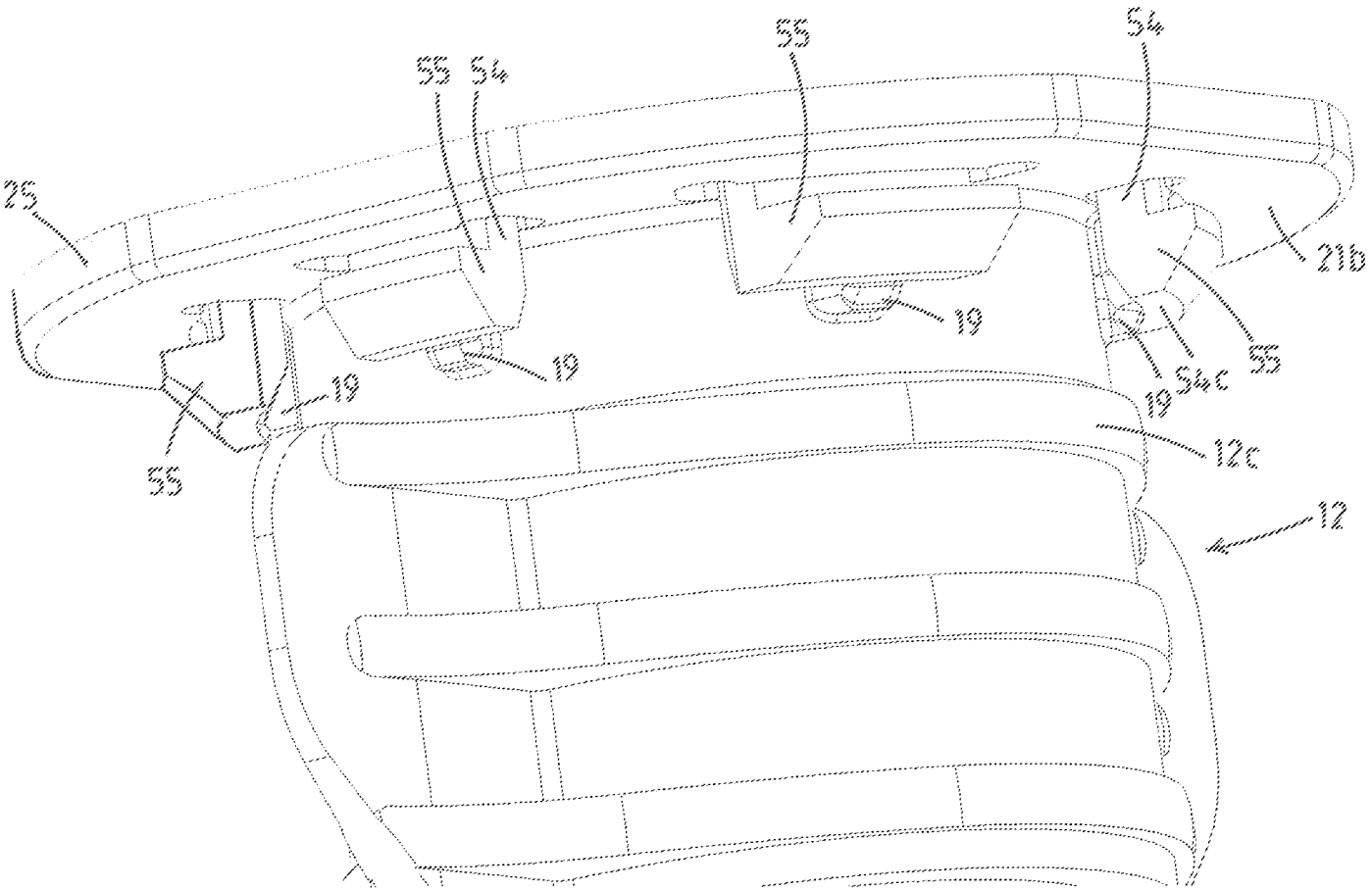
Figure 9:
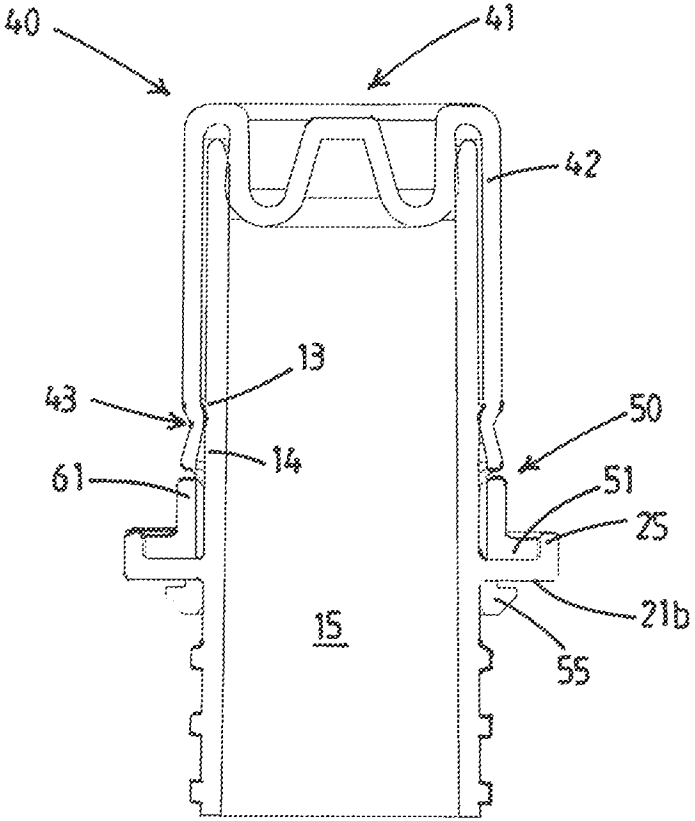
Figure 10:
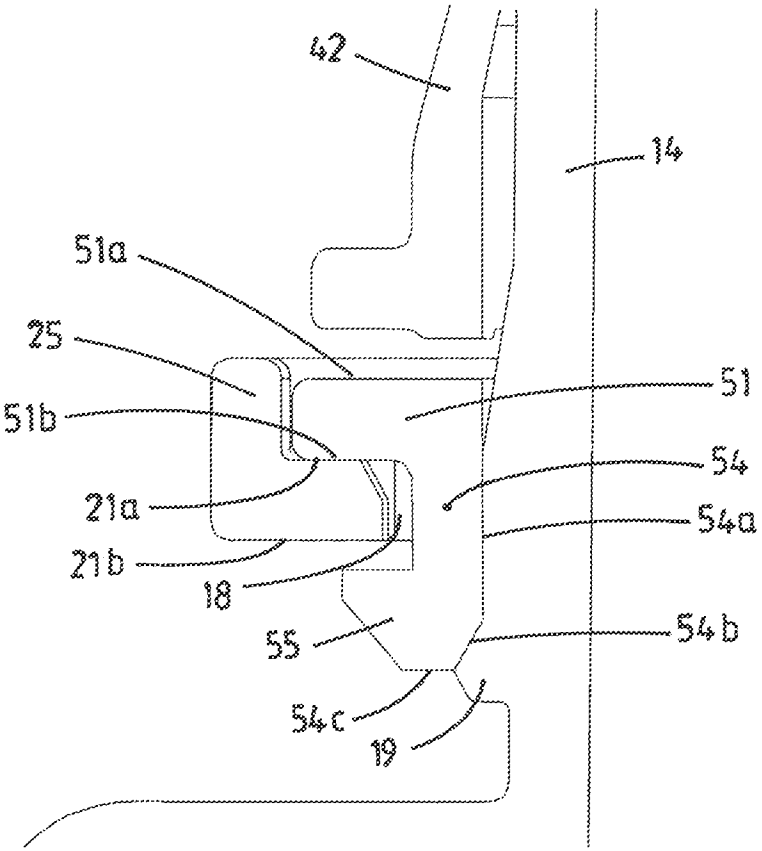
Figure 11:
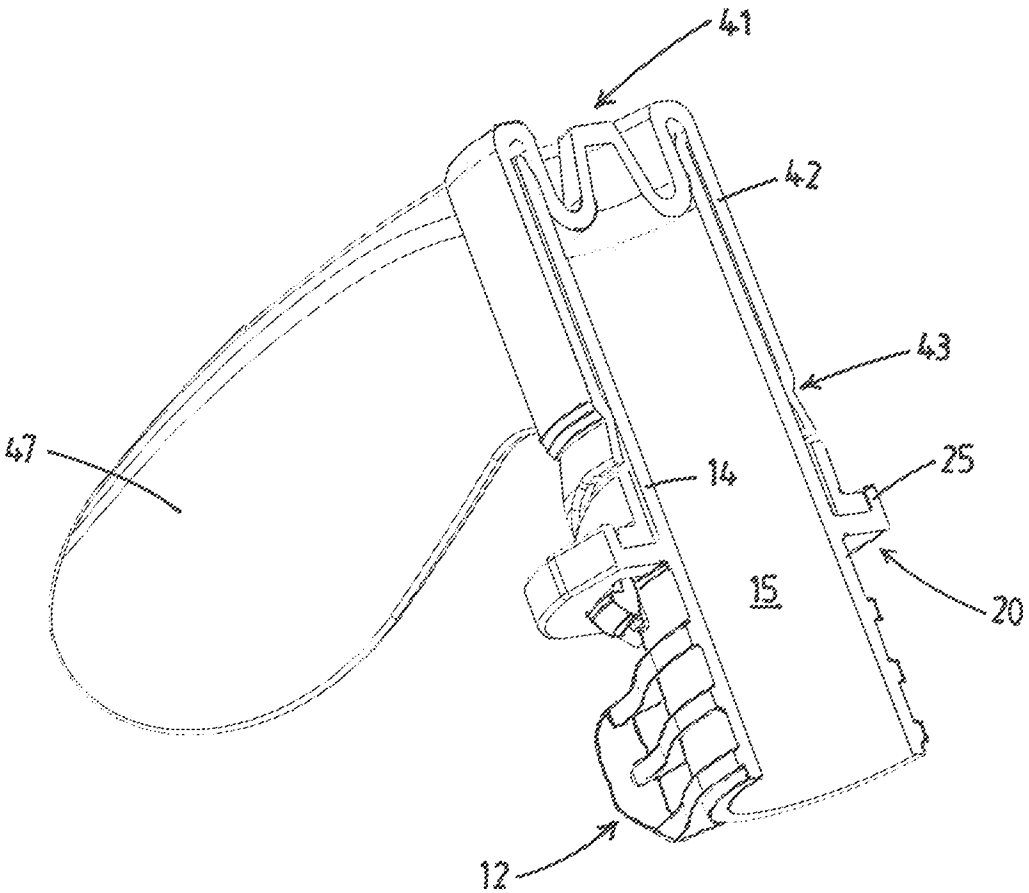
Figure 12:
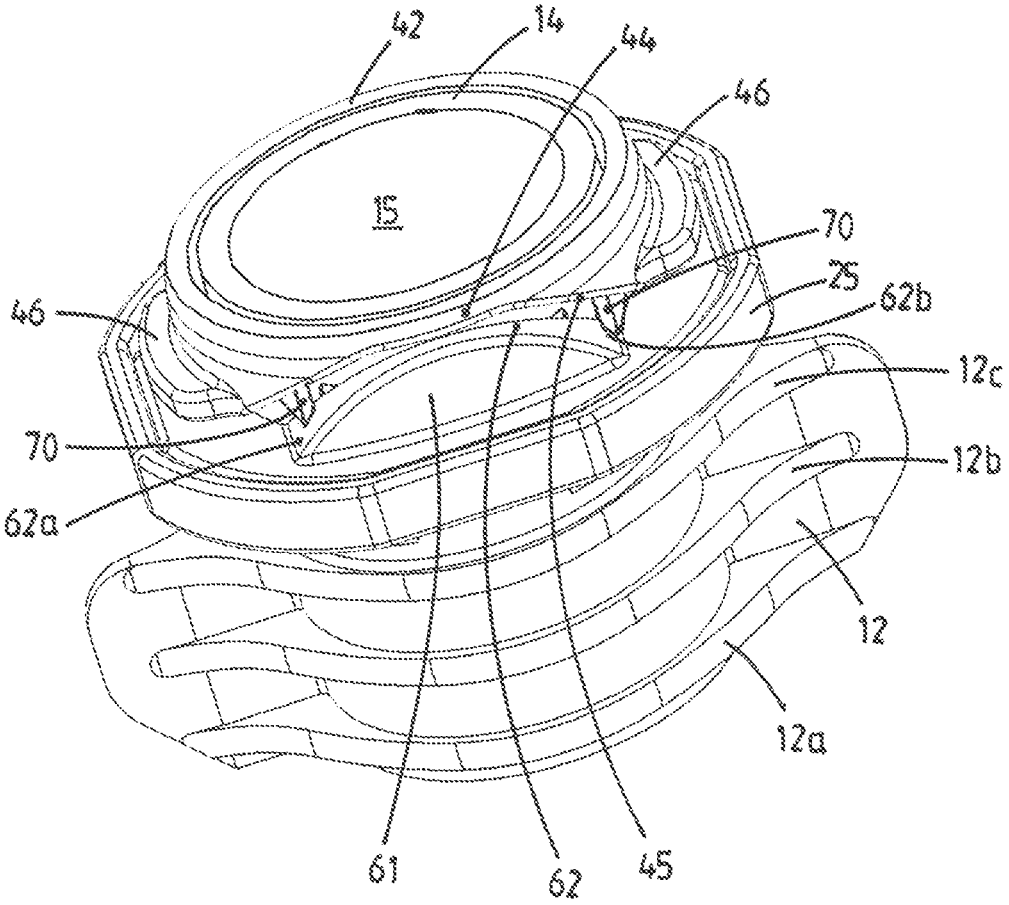
Figure 13:
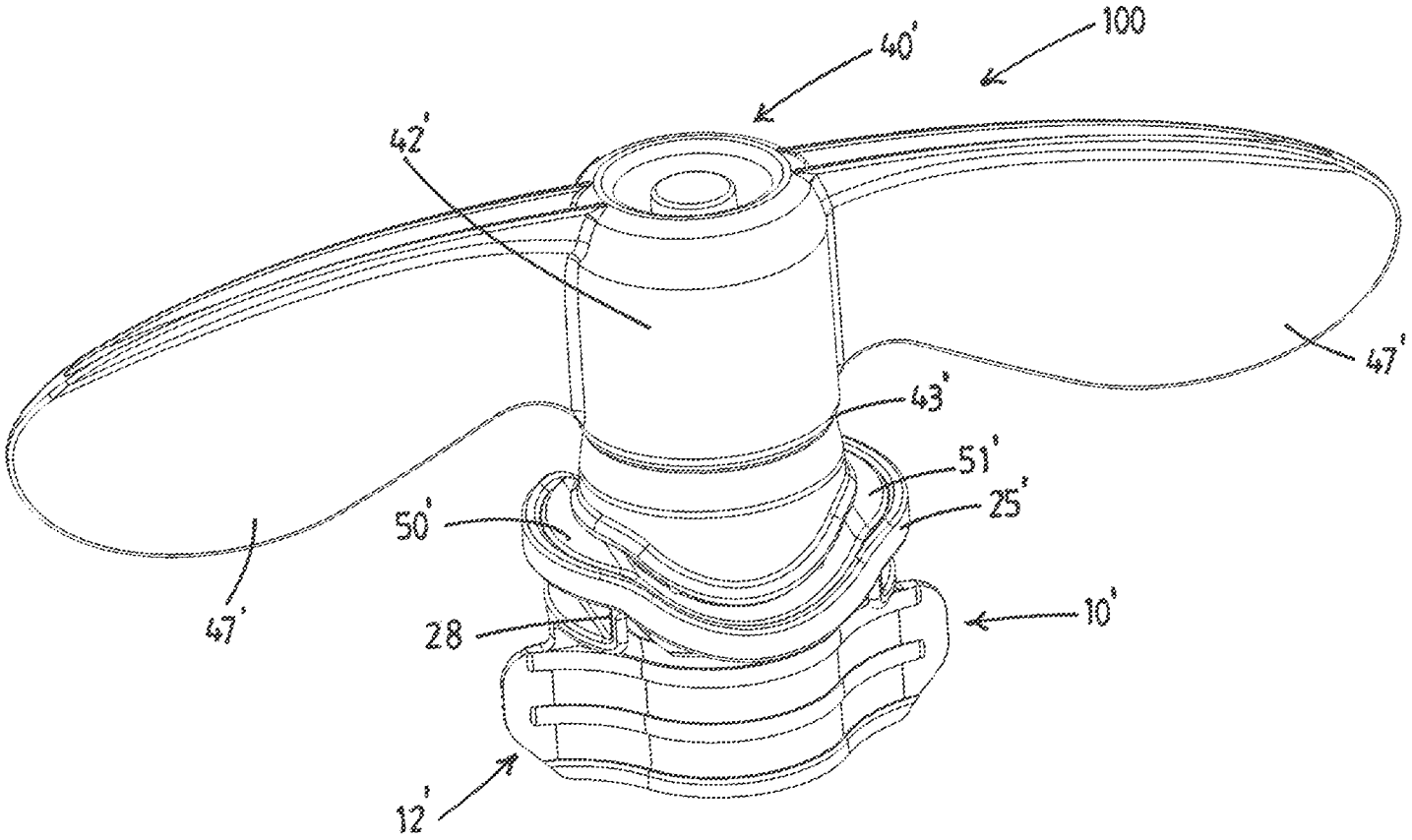
Figure 14:
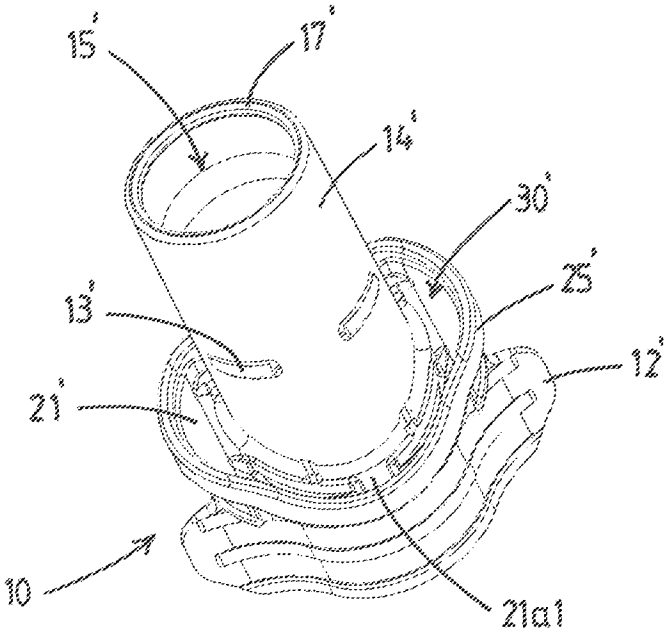
Figure 15:
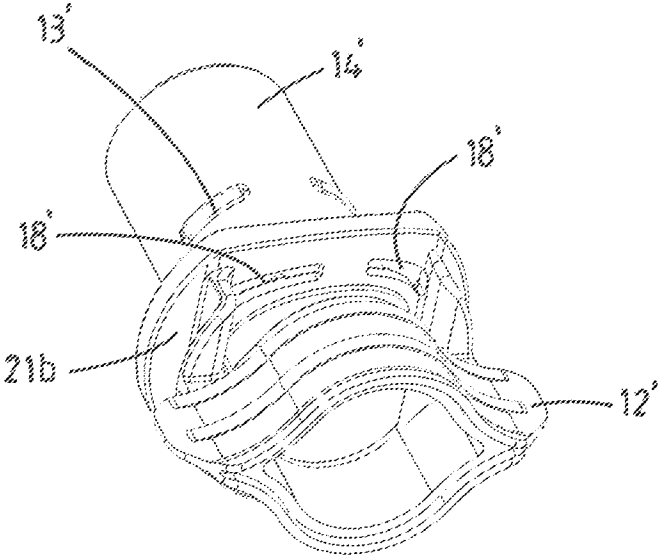
Figure 16:
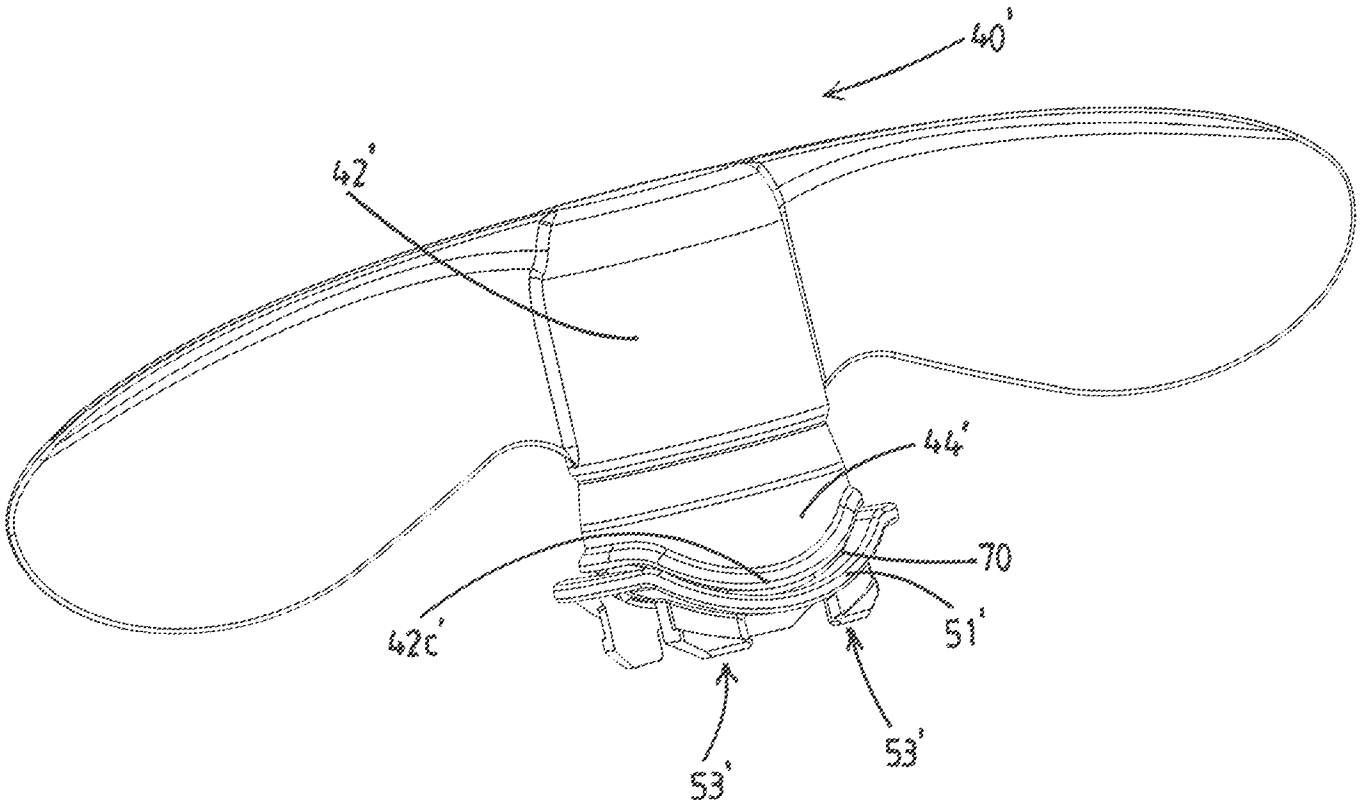
Figure 17:
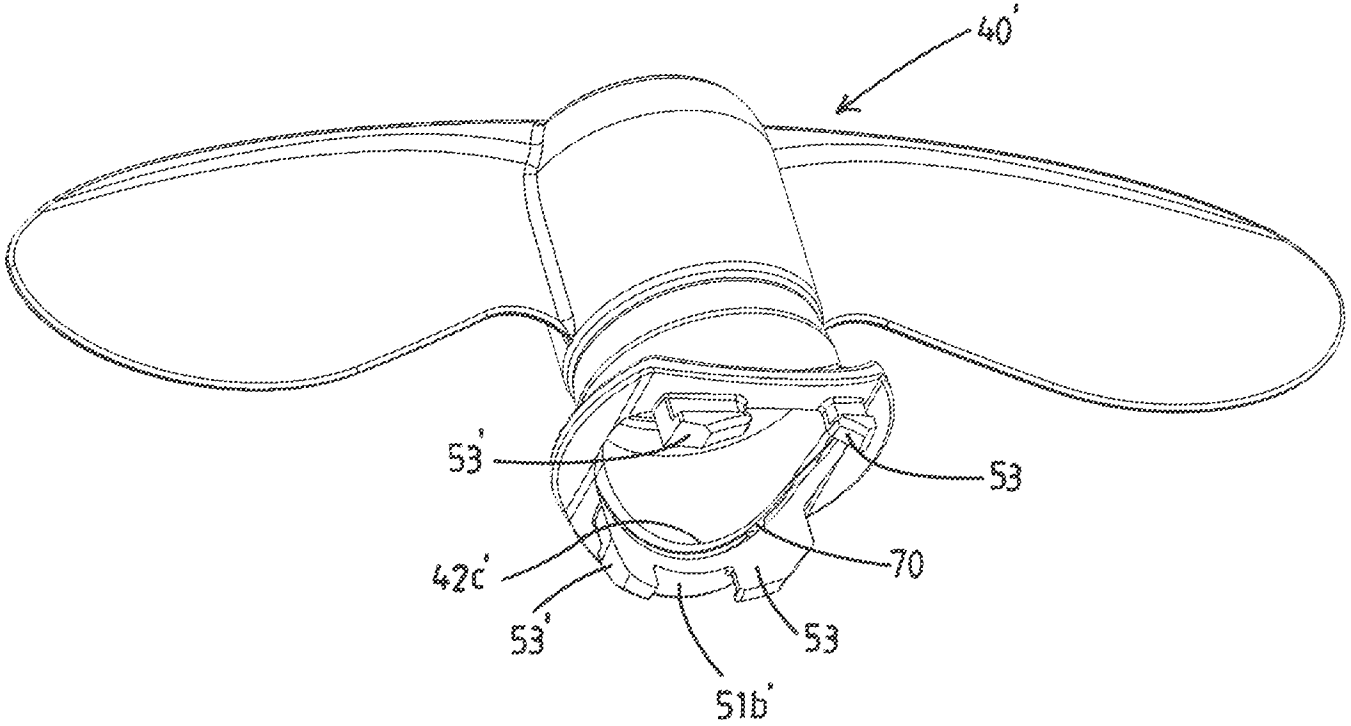
Figure 18:
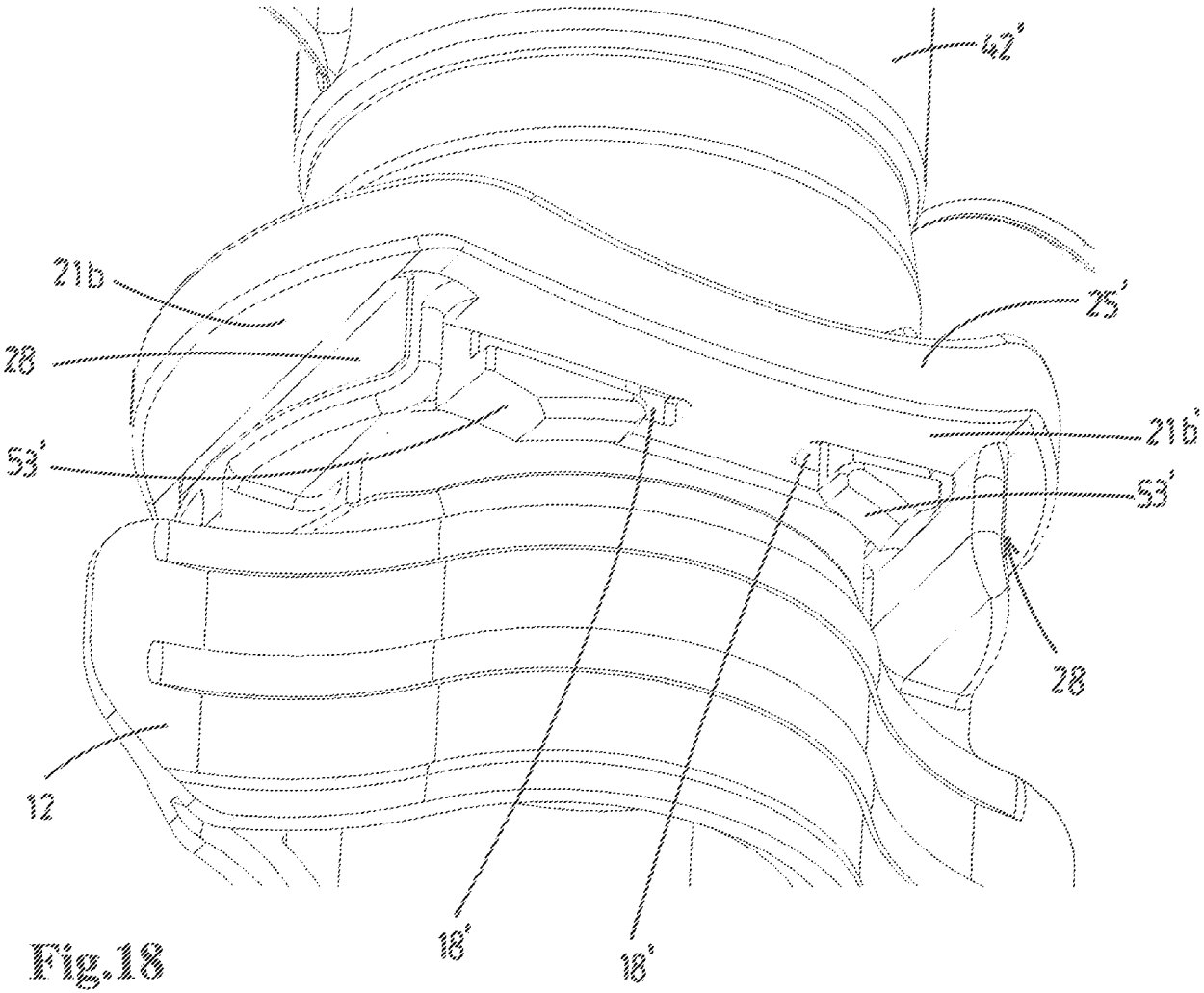
Figure 19:
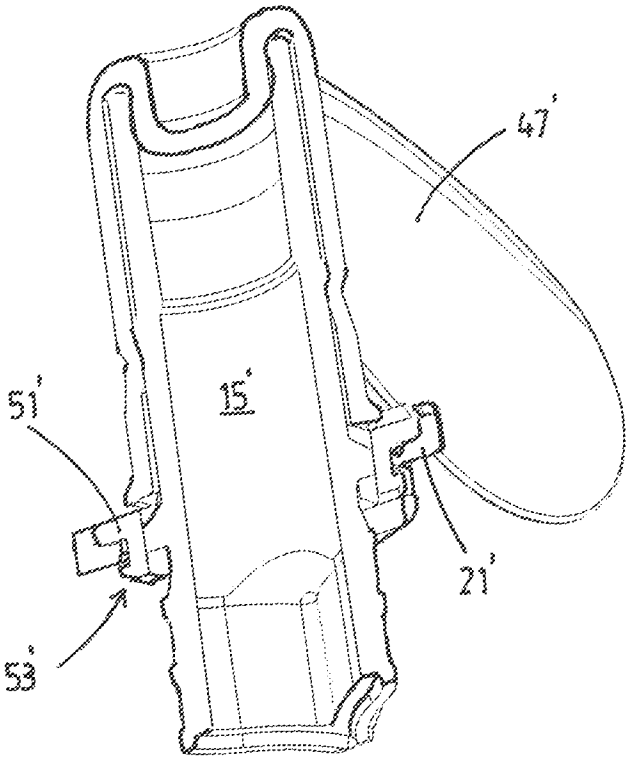
Figure 20:
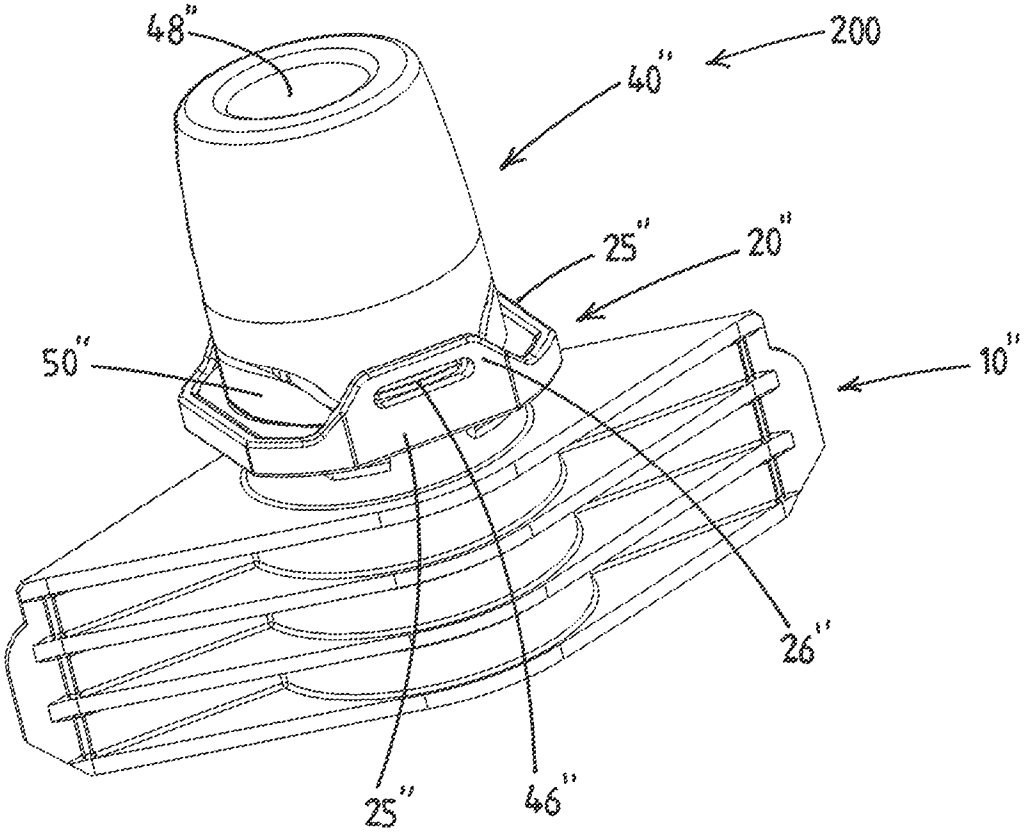
Figure 21:
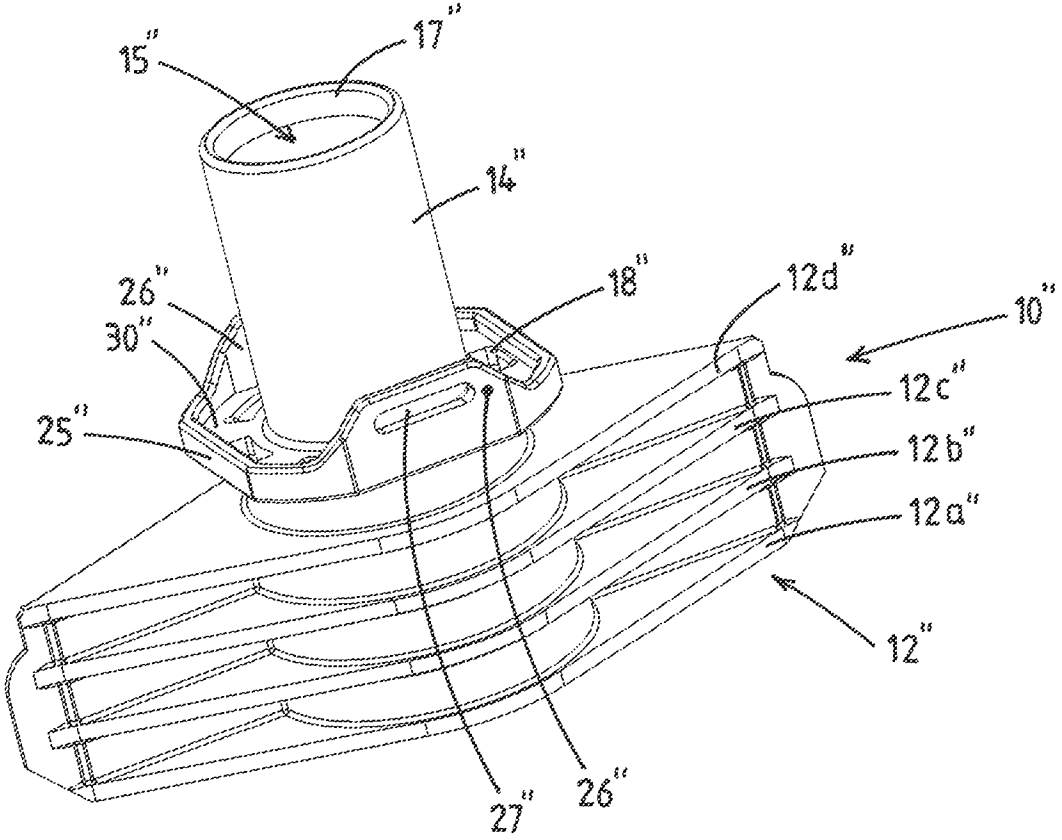
Figure 22:
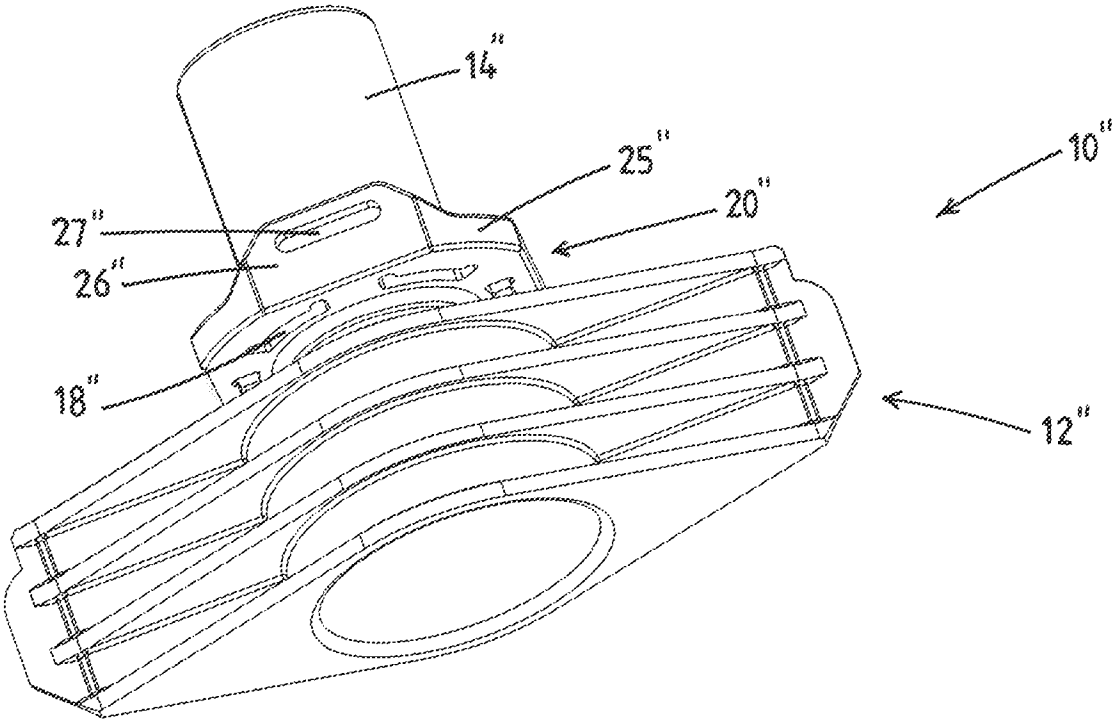
Figure 23:
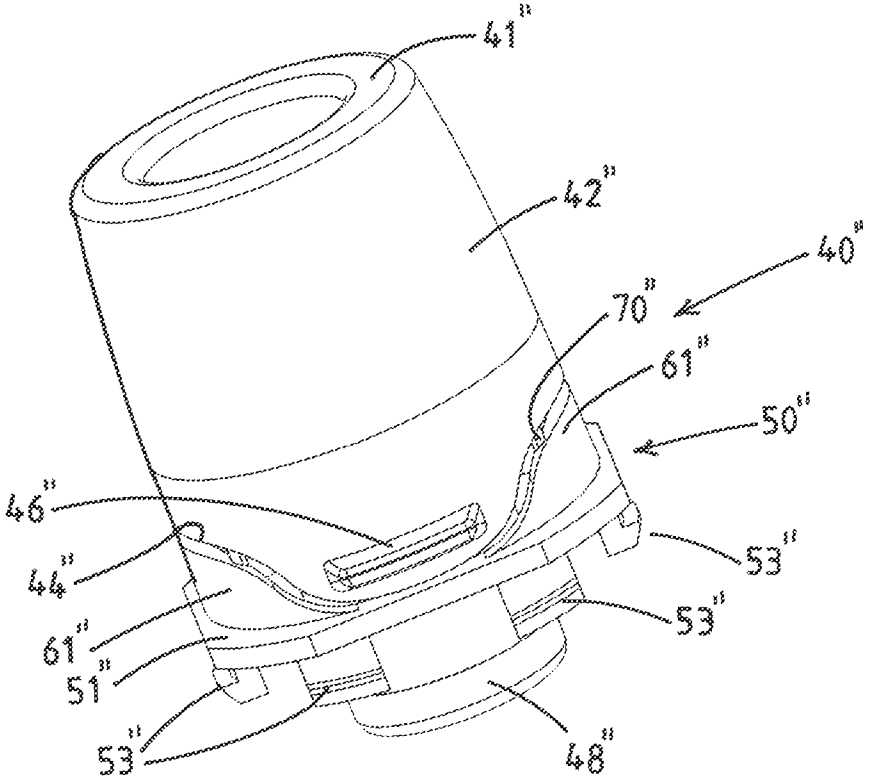
Figure 24:
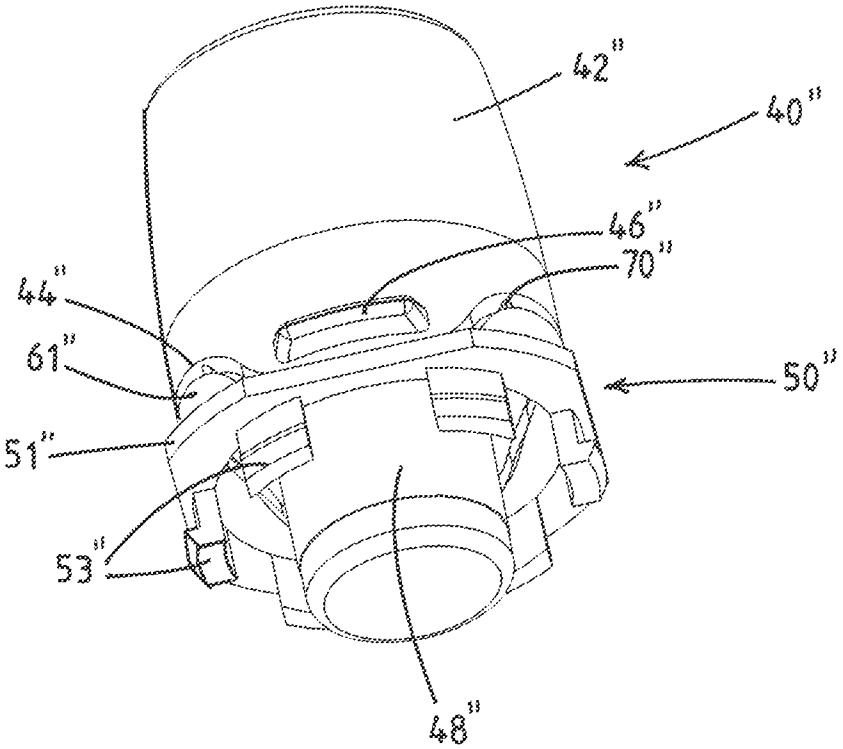
Figure 25:
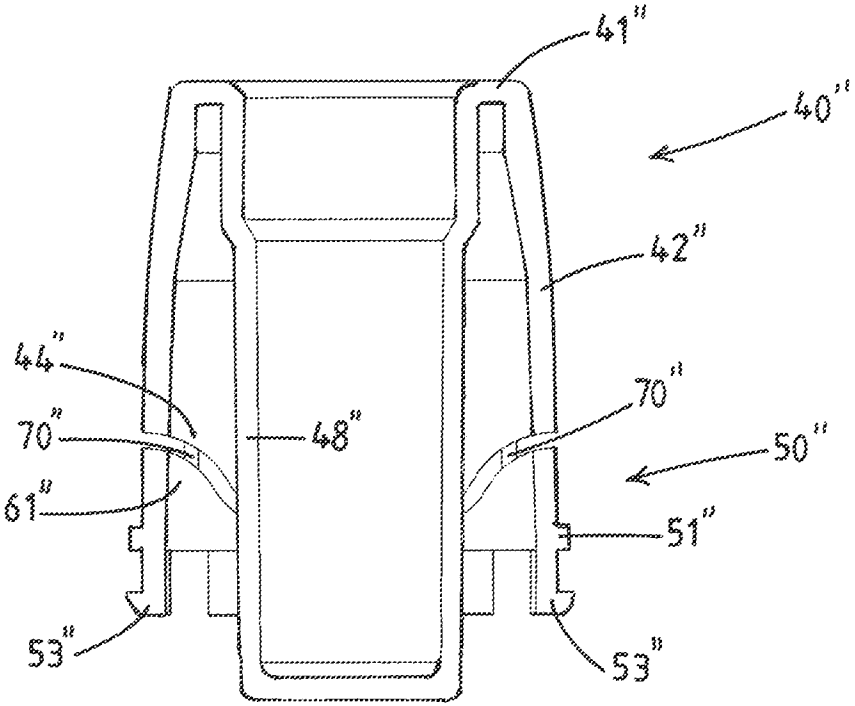
Figure 26:
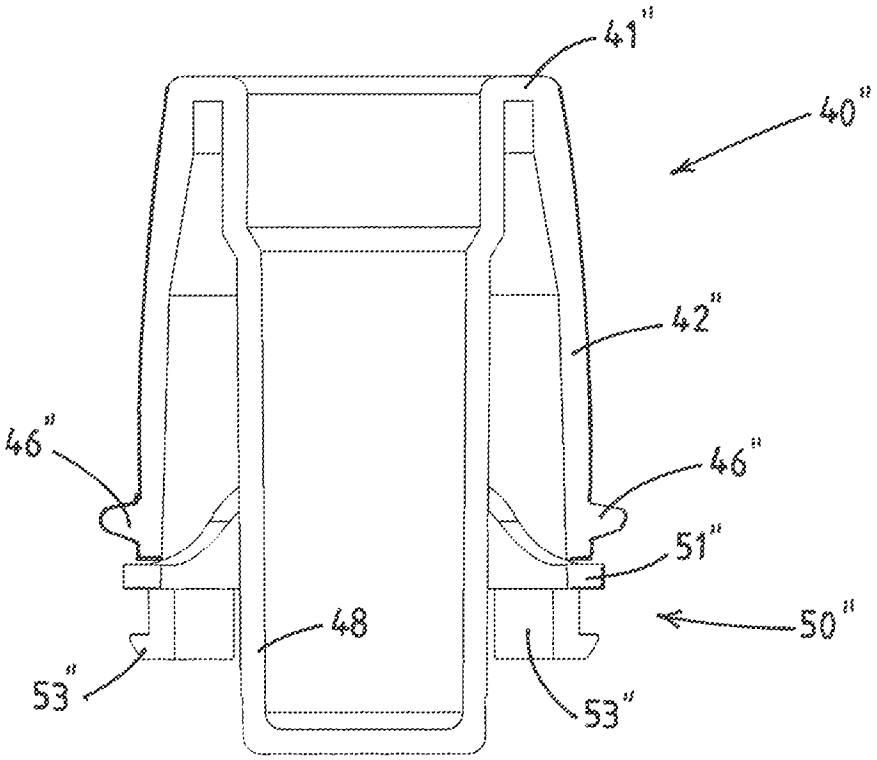
Figure 27:
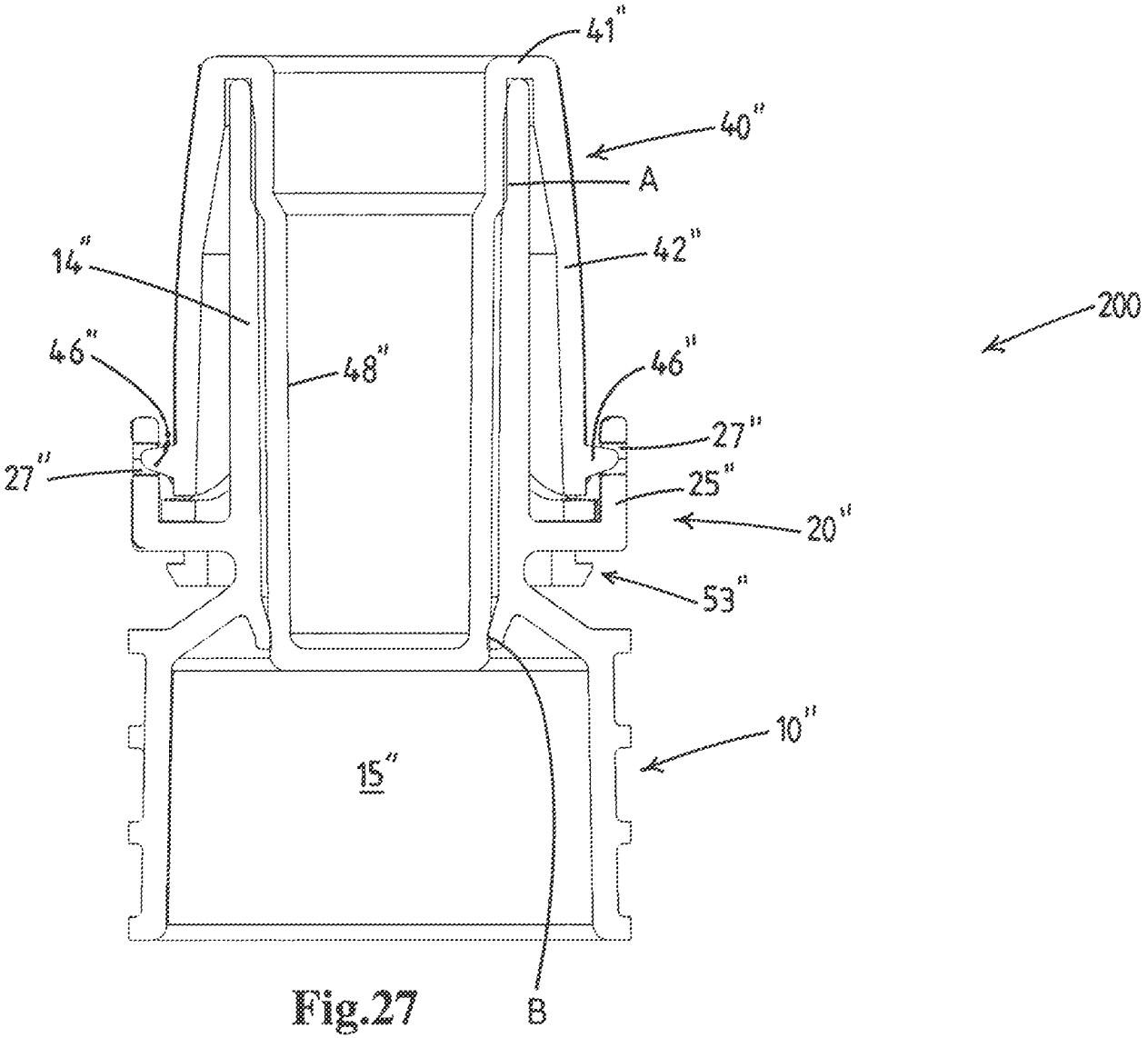
Figure 28:
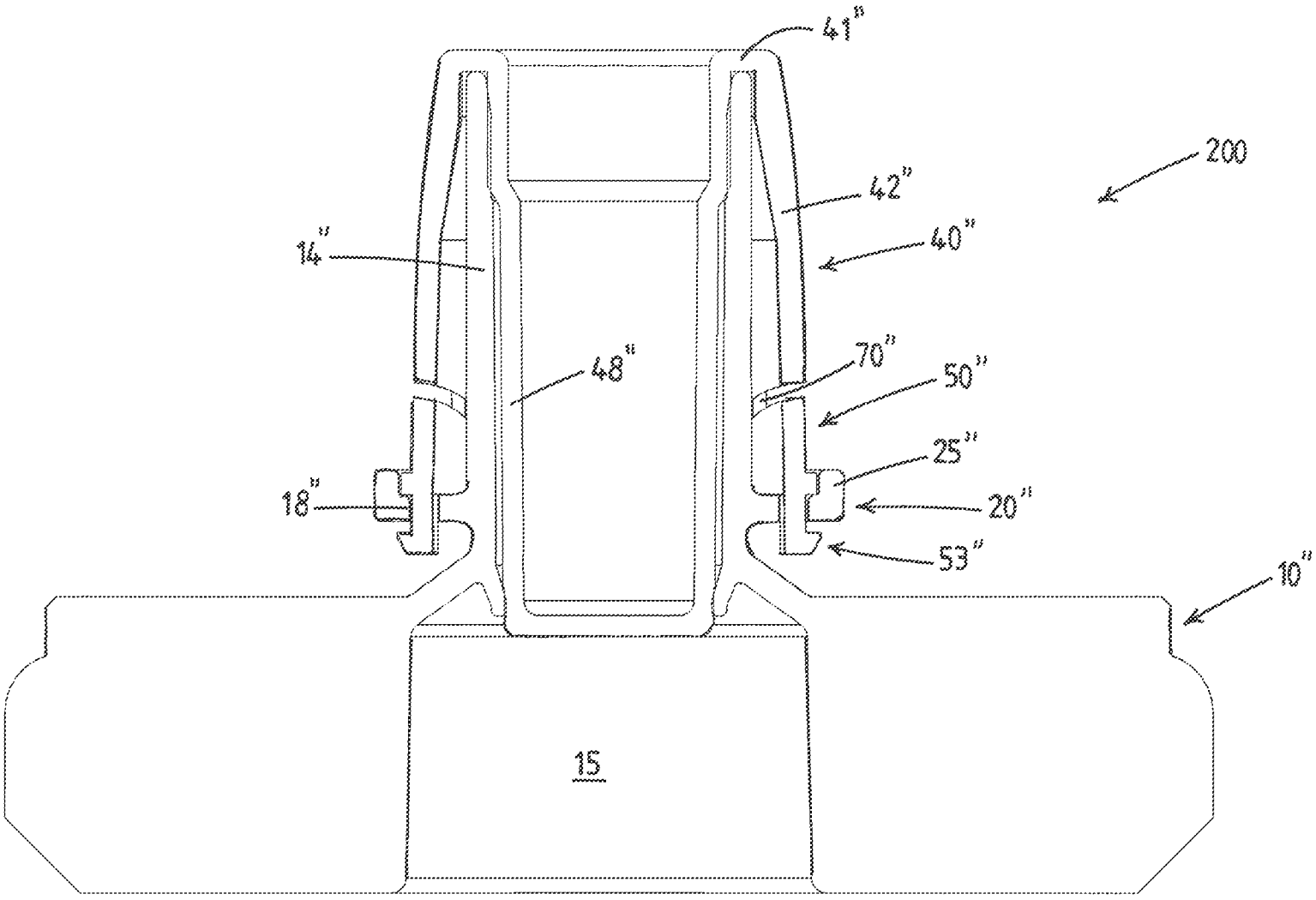
Figure 29:
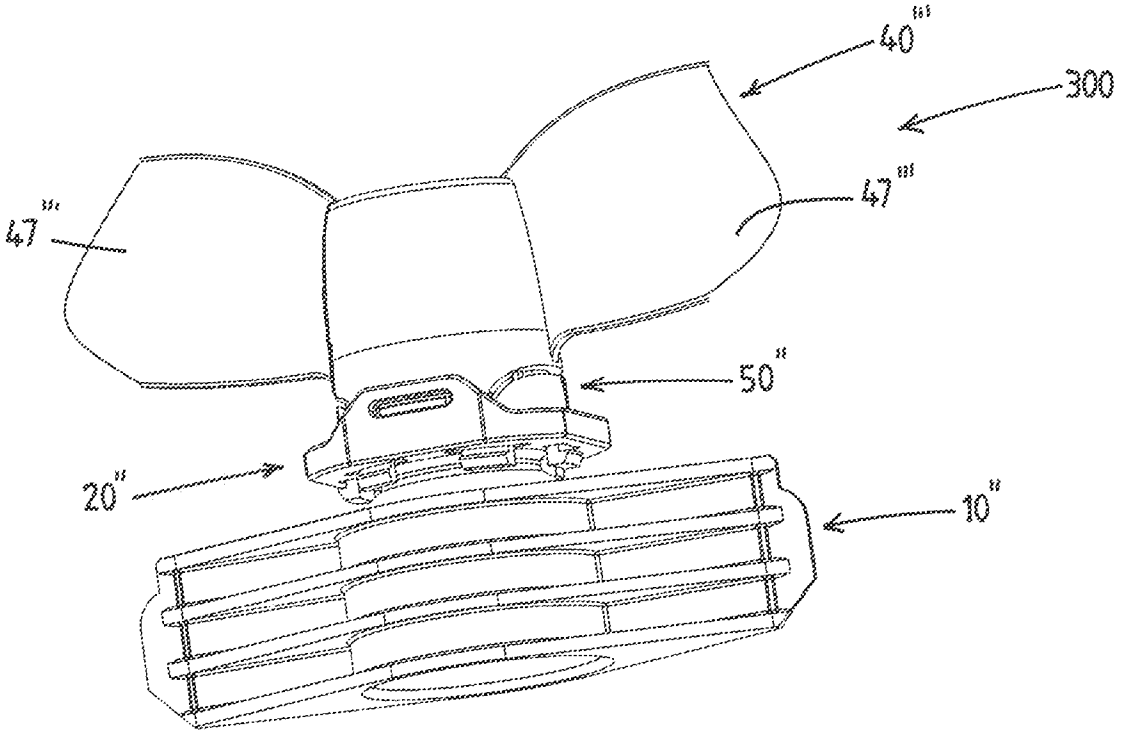
Figure 30:
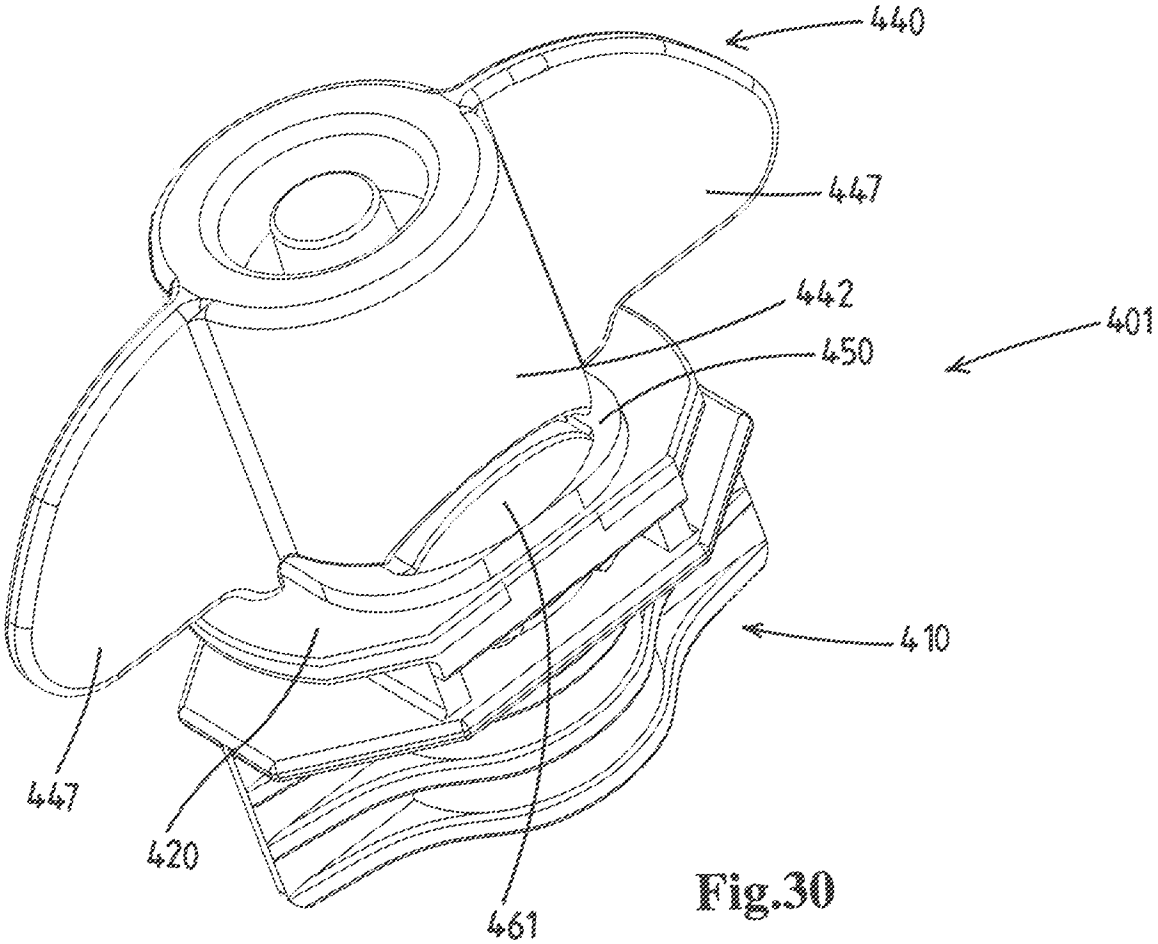
Figure 31:
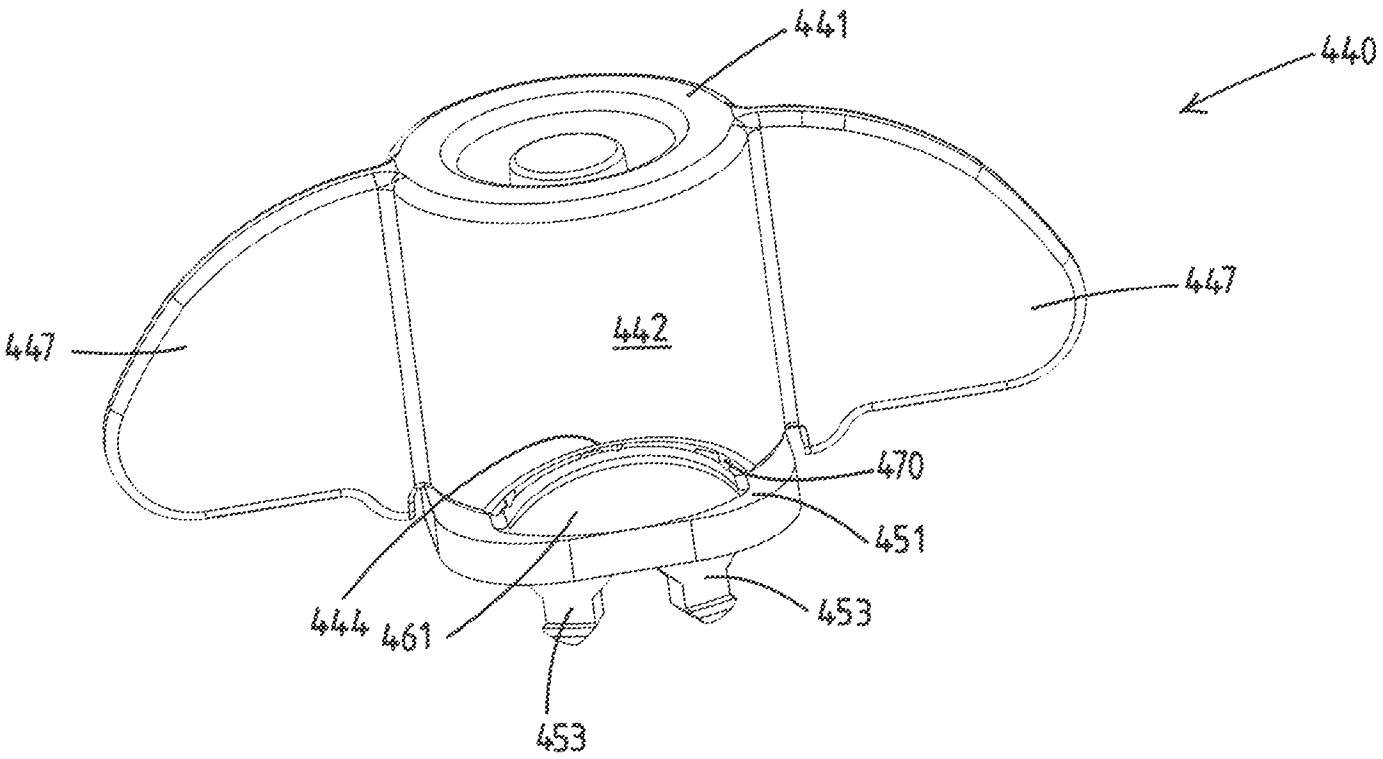
Figure 32:
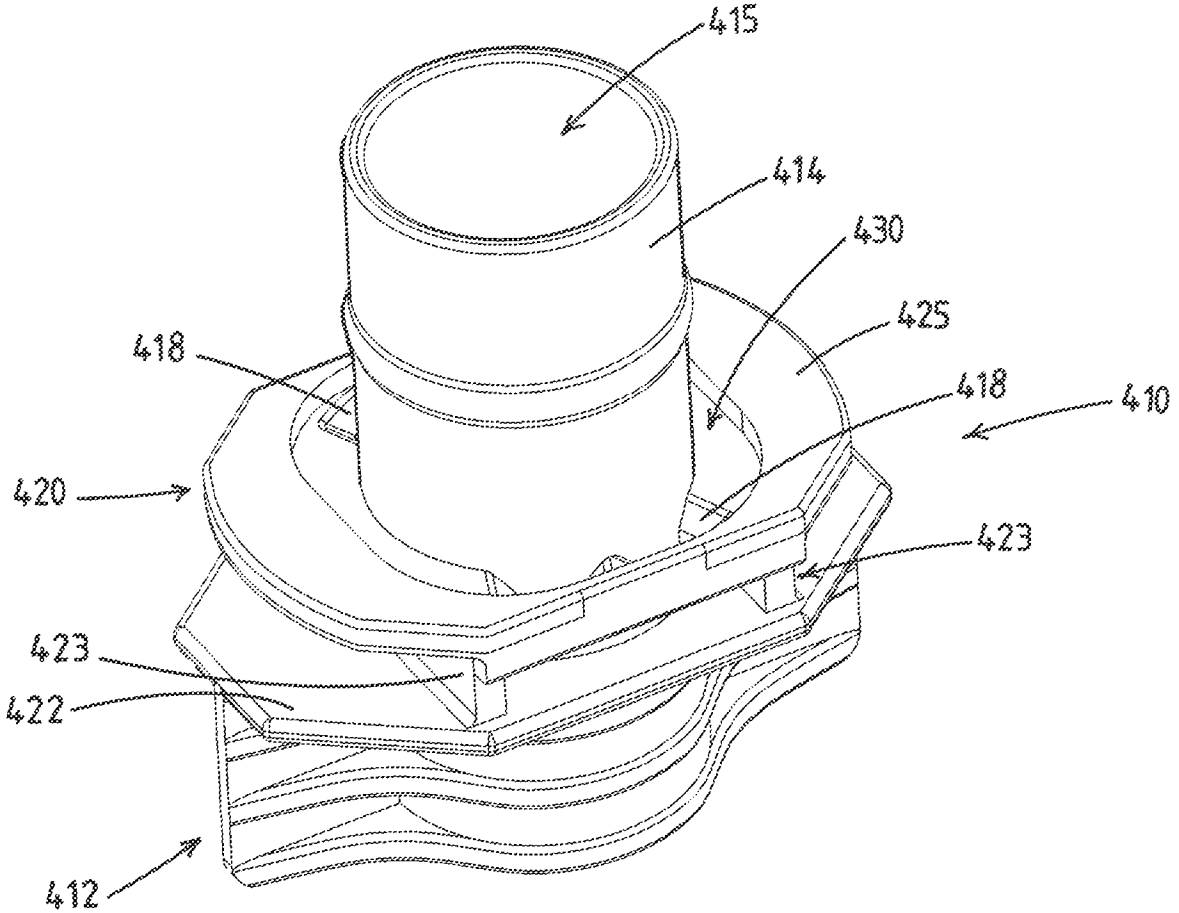
Figure 33:
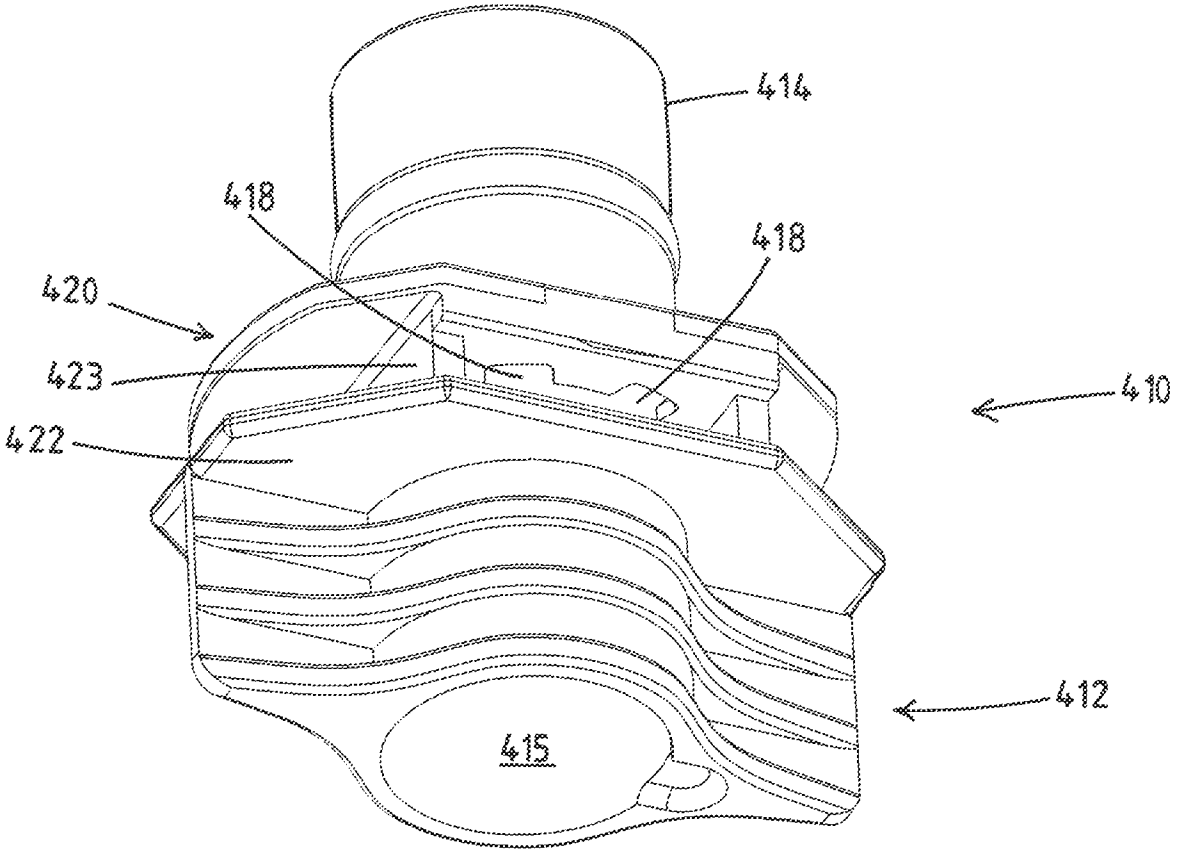
Figure 34:
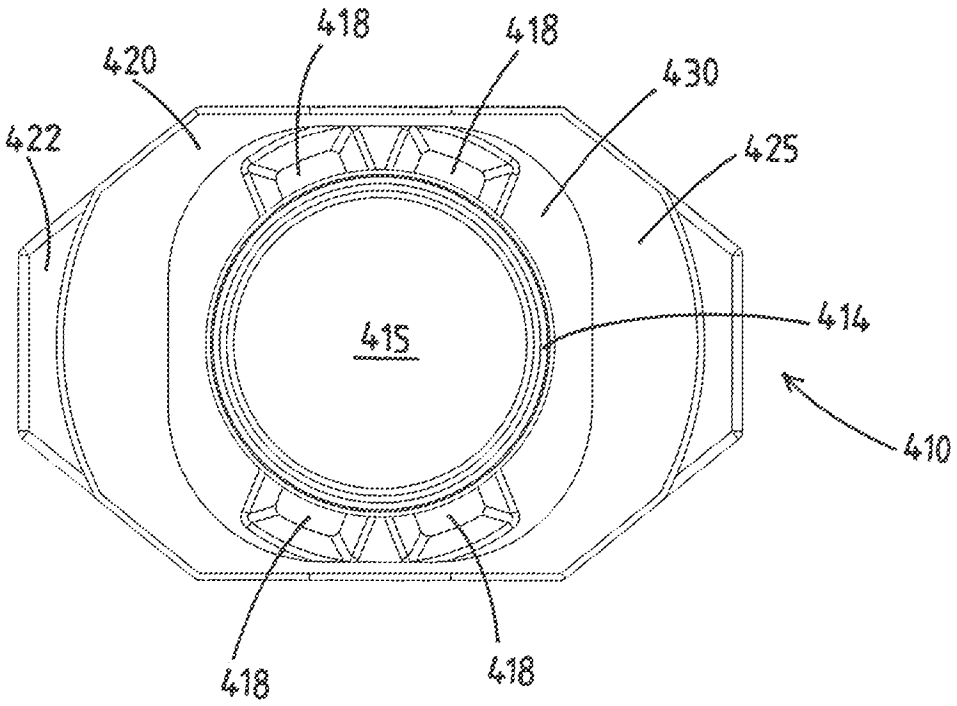
Figure 35:
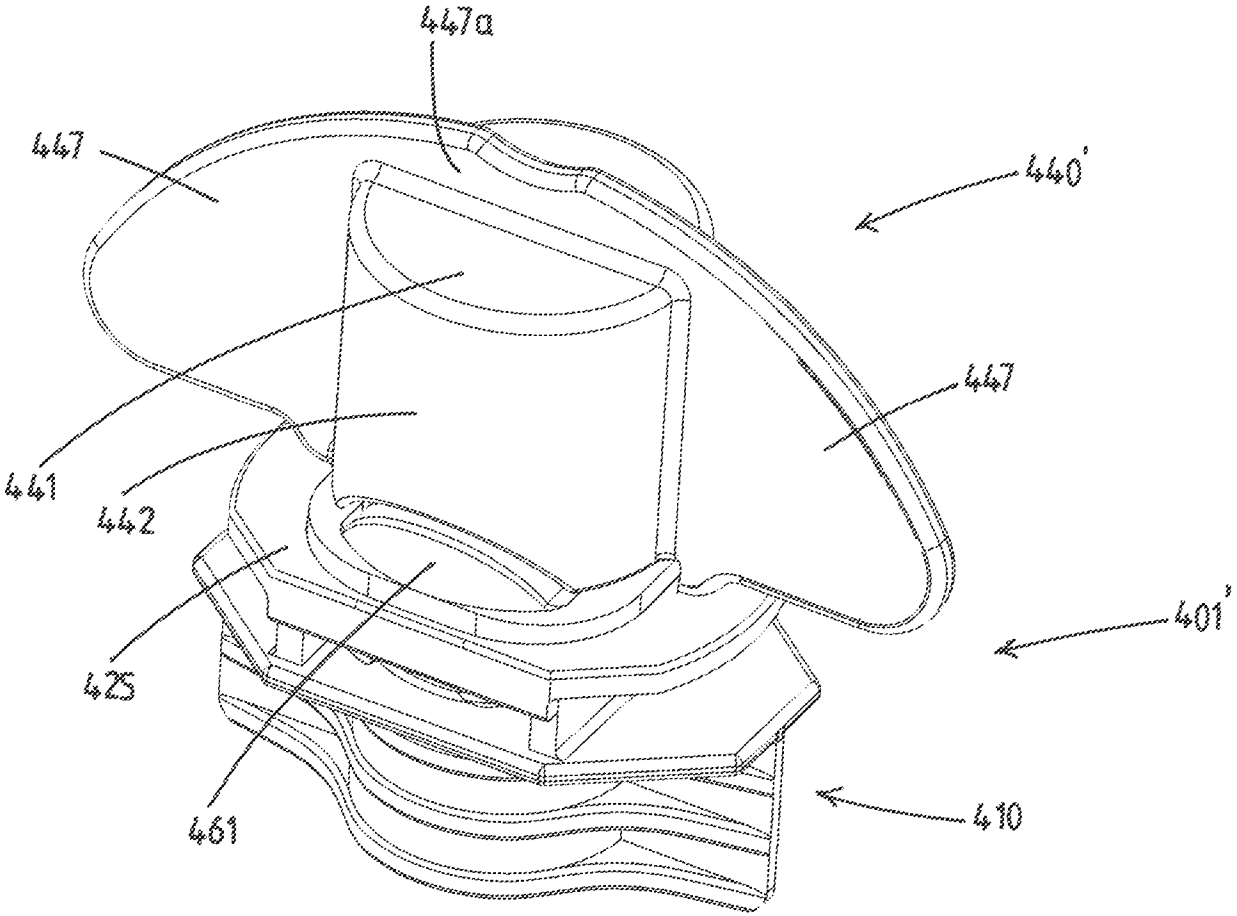

The invention and various aspects thereof will now be described with reference to the drawings. In the drawings:

FIG. 1 shows a first example of a closure assembly according to the invention in assembled state, FIG. 2 shows the spout of the closure assembly of FIG. 1, in a perspective view from above, FIG. 3 shows the spout of FIG. 2, in a perspective view from below, FIG. 4 shows the cap with integrated tamper-evident ring member of the closure assembly of FIG. 1, FIG. 5 shows the cap with integrated tamper-evident ring member of FIG. 4, in a perspective view from below, FIG. 6 shows a cross section of the cap with integrated tamper-evident ring member of FIG. 4, FIG. 7 shows the closure assembly of FIG. 1, in a perspective view from below, FIG. 8 shows a larger scale detail of the closure assembly of FIG. 7, FIG. 9 shows a cross section of the closure assembly of FIG. 1, FIG. 10 shows in cross section and on larger scale a detail of the closure assembly of FIG. 7, FIG. 11 shows in a cross sectional perspective view the closure assembly of FIG. 1, FIG. 12 shows in a horizontal cross sectional perspective view the spout and the lower region of the cap with integrated tamper-evident ring member of FIG. 1, FIG. 13 shows a second exemplary embodiment of a closure assembly according to the invention in assembled state, FIG. 14 shows the spout of the closure assembly of FIG. 13 in perspective view from above, FIG. 15 shows the spout of FIG. 14 in perspective view from below, FIG. 16 shows the cap with integrated tamper-evident ring member of the closure assembly of FIG. 13, FIG. 17 shows the cap with integrated tamper-evident ring member of FIG. 16 in perspective view from below, and FIG. 18 shows on a larger scale a detail of the closure assembly of FIG. 13, FIG. 19 shows a cross section of the closure assembly of FIG. 13, FIG. 20 shows a third example of a closure assembly according to the invention in assembled state, FIG. 21 shows the spout of the closure assembly of FIG. 20, in a perspective view from above, FIG. 22 shows the spout of FIG. 21, in a perspective view from below, FIG. 23 shows the cap with integrated tamper-evident ring member of the closure assembly of FIG. 20, FIG. 24 shows the cap with integrated tamper-evident ring member of FIG. 23, in a perspective view from below, FIG. 25 shows a cross section of the cap with integrated tamper-evident ring member of FIG. 24, FIG. 26 shows another cross section of the cap with integrated tamper-evident ring member of FIG. 24, FIG. 27 shows a cross section of the closure assembly of FIG. 20, FIG. 28 shows another cross section of the closure assembly of FIG. 20, FIG. 29 shows a fourth example of a closure assembly according to the invention in assembled state, FIG. 30 shows a fifth example of a closure assembly according to the invention in assembled state, FIG. 31 shows the cap with integrated tamper-evident ring member of the closure assembly of FIG. 30, FIG. 32 shows the spout of the closure assembly of FIG. 30, in a perspective view from above, FIG. 33 shows the spout of FIG. 32, in a perspective view from below, FIG. 34 shows the spout of FIG. 32 from above, FIG. 35 shows a sixth example of a closure assembly according to the invention in assembled state.

With reference to FIGS. 1-12, a first example of a closure assembly according to the invention will be described in more detail.

FIG. 1 shows a closure assembly 1 in assembled stated. As explained, in an embodiment, this pre-assembled closure assembly can be fitted to a container, e.g. a collapsible pouch container.

The closure assembly 1 is composed of two components, namely on the one hand an article 10, here embodied as a spout 10, and on the other hand a cap 40 provided with an integrated tamper-evident ring member 50.

The spout 10 is made, e.g. injection moulded, of a plastic material and forms a tubular neck 14 around a product passage 15 in the spout. The neck has a main axis 16, which is discussed herein as being vertical. The neck 14 forms a mouth 17 at a top end of the product passage 15. It will be appreciated that the term vertical, as well as top, bottom, upper, lower, etc. are merely used to identify relative orientation and location of components and details thereof in the closure assembly. In practical use the spout or other article may be arranged at the top of a container, e.g. pouch container, but also other arrangements, e.g. the neck facing sideways, being inclined, facing downwards, etc. are comprised within the invention.

The spout 10 further comprises a circumferential flange structure 20 which comprises an annular flange portion 21 that is integrally formed, e.g. injection molded, to the neck 14 and extends around the neck 14. The flange portion 21 has a top face 21*a*, a bottom face 21*b*, and a periphery 21*c*, here a circular outer contour periphery.

The flange structure 20 further comprises a peripheral protective rim portion 25 that is integral to and extends upwards from the flange portion 21 at the periphery 21*c* thereof, so that the top face 21*a* of the flange portion 21 and the protective rim portion 25 define an annular recess 30 around the neck 14.

The spout 10 represents one embodiment of a fitment that is configured to be secured to a container body, e.g. of a collapsible pouch container.

The spout 10 has a lower connector portion 12, here embodied as a seal boat, that is adapted to be secured, e.g. by heat-sealing, between opposed film walls of a collapsible pouch container. The neck 14 extends upwards from the top of the lower connector portion 12. In this example, the seal boat portion 12 is provided with horizontal welding ribs 12*a,b,c* in vertically spaced apart horizontal planes, the ribs 13 serving to be welded to the film walls of the pouch container as is known in the art.

In another embodiment, the lower connector portion 12 may be embodied with a lower circumferential flange or plate portion that is adapted to be secured or secured onto a panel of a container, e.g. a panel of a carton or a wall of a collapsible pouch.

The cap 40 that is provided with the integrated tamper-evident ring member 50 is made, e.g. injection moulded, of a plastic material.

The cap 40 with ring member 50 is adapted to be secured on the neck 14 of the spout 10 by means of an axial securing motion along the main axis 16.

The cap 40 has a top wall structure 41 and a downward depending skirt 42.

As illustrated, the top wall structure 41 may comprises a W-seal arrangement protruding into the neck 14. Herein the W-seal arrangement comprises a downward projecting bulbous and annular top wall section around a central raised top wall section. It will be appreciated that the top wall structure 41 could have other designs, e.g. like a substantially planar disc, or with a downwardly protruding hollow pin design that fits inside the neck to provide a seal at a position well below the mouth, etc.

The skirt 42 has an interior side 42*a*, an exterior side 42*b*, and a lower edge 42*c* that is remote from the top wall structure 41.

The tamper-evident ring member 50 is integrally formed to the lower edge 42*c* of the skirt of the cap 40 and is connected to this lower edge via one or more breakable bridges 70.

The cap 40 is adapted to seal the product passage 15 in a closed position of the cap on the neck 14.

The cap 40 is adapted to be manually removed from the neck 14 by a user to open the product passage 15. In this example, as preferred in the context of the invention, the cap 40 is a quarter-turn type opening snap-on type cap, so that rotating the cap over about a quarter turn causes sufficient lift to disengage a snap retention of the cap and, also, breaks the breakable bridges 70 as will be discussed below.

The tamper-evident ring member 50 comprises an annular ring member flange portion 51 that has a top face 51*a*, a bottom face 51*b*, an inner face 52*a* directed to the neck 14, and an outer face 52*b*.

Multiple hook members 53 are integrally formed to the bottom of the ring member flange portion 51. These hook members 53 are distributed in a circumferential direction of the ring member flange portion 51.

Each hook member 53 comprises a resilient leg 54 having an upper end integral with the ring member flange portion 51 and protruding downward from the ring member flange portion.

Each hook member 53 further comprises a hook portion 55 at the lower free end of the leg 54. In the depicted embodiment, as practically preferred, the hook portion 55 is directed outwards. As preferred, the flange portion 51 extends further outwards than the hook portion 55.

The annular flange portion 21 on the neck 14 of the spout is provided with multiple hook member passages 18, distributed in circumferential direction about the neck, which passages 18 each extend between the top face 21*a* and the bottom face 21*b* through this annular flange portion 21.

Each hook member passage 18 is adapted to receive a respective hook member 53 when the cap 40 with the integrated tamper-evident ring member 50 is axially mounted or secured on the neck 14 by means of an axial securing motion along the main axis 16. Herein the hook portion 55 of each hook member 53 engages, e.g. snaps, underneath the bottom face 21*b* of the annular flange portion 21 on the neck 14 of the spout 1.

The periphery of the annular flange portion 51 of the ring member 50, here of non-circular contour, is shaped to fit within the, here equally non-circular contoured, protective rim portion 25 as the annular flange portion 51 is inserted in the annular recess 30 upon axially mounting of the cap 40 with the integrated tamper-evident ring member 50 on the neck 14.

It will be appreciated that the adjoining contours of the annular flange portion 51 and of the rim portion 25 may also be of other non-circular designs, e.g. square, hexagonal, oval, etc. The mating non-circular contours may be present in view of an anti-rotation locking effect, so that the ring member 50 is hindered from rotating about the neck. The same anti-rotation effect may also, or alternatively, be provided for by other measures, e.g. by the hook members and their corresponding passages, and/or by mating reliefs on the adjoining lower face of the flange portion 21 and upper face of the flange portion 21. In an embodiment, the adjoining contours of the annular flange portion 51 and of the rim portion 25 may be circular.

The peripheral protective rim 25 is configured to obstruct a lateral access from the outside to the interface between the top face 21*a* of the flange portion 21 of the spout 10 and the bottom face 51*b* of the flange portion 51 of the ring member 50. For example one cannot access said interface by biting on the assembly, e.g. when used in combination with a child food or beverage container, or with cutlery, e.g. a knife, etc. in an attempt, e.g. unconscious, to dislodge the ring member 50, possibly along with the cap 40, from the spout 10.

The closure assembly 1 is embodied such that upon first time opening of the closure assembly by removal of the cap 40, here a quarter turn of the cap 40, by a user the one or more breakable bridges 70 break and the ring member 50 is retained in the recess 30 of the spout 10 by means of the hook members 53.

As shown here it is preferred that the protective rim portion 25 is devoid of openings therein. This strengthens the portion 25, and thus the entire circumferential flange structure, and further reduces the possibility for lateral access to the ring member 50.

The protective rim portion 25 has a height such that in the secured position of the cap provided with the integrated tamper-evident ring member an outer annular zone of the top face 51*a* of the flange portion 51 thereof does not protrude above the protective rim portion 25. Even more preferred, e.g. as can be seen in FIGS. 9-12 this outer annular zone of the top face is located lower than the top of the rim portion 25. Hereby access to the flange portion 51 is difficult.

As illustrated, e.g. in FIGS. 2, 3, 8, 9, and 10, the hook members passages 18 may be located directly adjoining the neck 14.

Preferably, the passages 18 are located radially spaced inward from the rim portion 25.

The legs 54 of the hook members 53 each have an inner leg face 54*a* facing the neck 14. As preferred, see e.g. FIGS. 5, 6, 9, 10, this inner leg face 54*a* adjoins, or is continuous with, the inner face 52*a* of the flange portion 51 of the ring member 50.

As shown here, it is preferred for all hook members 53 to have a leg 53 with an inner bevel face 54*b* at the lower end thereof, here at a junction of an inner leg face 54*a* and a lower end face 54*c* of the leg 54.

As shown here, the neck 14 may be integrally formed with a corresponding bevel faced boss 19 at a location below the corresponding hook member passage 18, such that upon axially mounting the cap 40 with the integrated tamper-evident ring member 50 on the neck 14 by means of an axial securing motion along the main axis 16, the bevelled face of the boss 19 contacts the inner bevel face 54*b* of the leg 54 and thereby assists in keeping the hook portion 55 of the hook member 53 engaged, e.g. snapped, underneath the bottom face 21*b* of the annular flange portion 21 on the neck 14 of the spout 10.

As illustrated, in an embodiment, the outside or outer contour of the protective rim portion 25 provides at least one pair of opposed parallel side faces. Here two pairs 26, 27 that are orthogonal to one another are provided, here so that the protective rim portion 25 is four-sided with rounded corner faces.

In an embodiment, as shown here, the upper face 21*a* of the flange portion 21 on the neck 14 of the spout 10 is substantially planar, radial and perpendicular to the main axis 16. The bottom face 51*b* of the ring member flange portion 51 here equally is substantially planar, radial and perpendicular to the main axis 16.

The closure assembly 1 here, as preferred, comprises a snap-on type cap 40 providing in use of the closure assembly a snap-on functionality so that said axially securing motion, e.g. by a capping device, causes the cap 40 to snap onto the neck 14. Here, as preferred, the interior side of the skirt 42 of the cap 40 and the exterior side of the neck of the article have co-operating snap connector formations. A first snap ridge 13 is provided on the exterior side of the neck 14, between the mouth and the circumferential wall structure, and a second snap ridge 43 is provided on the interior side of the skirt in order to provide the snap-on functionality. As preferred and as shown the first snap ridge 13, axially spaced from the circumferential flange structure, is formed by a series of snap ridge segments that are circumferentially spaced from one another. The inside of the skirt of the cap 40 here forms a circumferentially continuous snap ridge. For example, the snap-on type cap 40 can be replaced on the neck 14 after first time opening, with the snap features 13, 43 then properly retaining the cap on the neck.

In order to facilitate the opening of the closure assembly by the user, who is here expected to turn the cap 40 over a quarter turn for opening of the closure, the closure assembly comprises:

- at least one first cam portion 61 defining a cam surface 62, which cam surface 62 is angled with respect to the main axis 16, seen when the cap 40 with ring member 50 are secured on the neck 14, which first cam portion 61 is integrally formed on the flange portion 51 of the tamper-evident ring member 50, and
- at least one second cam portion 45 defining a cam follower surface 46 adapted to interact with the cam surface 62 of the first cam portion 61, which second cam portion 45 is integrally formed on the lower edge of the skirt 42, wherein—upon first time opening of the closure assembly by rotation of the cap 40 relative to the spout 10 about the main axis 16—the first and second cam portions 61, 45 interact in order to cause axial lifting of the cap 40 relative to the neck 14, so that the co-operating snap connector formations 13, 43 disengage.

In the illustrated embodiment a pair of first cam portions 61 is integrally formed at the top face 51*a* of the ring member flange portion 51, at diametrically opposed locations relative to the opening through which the neck 14 extends. A pair of second cam portions 45 is integrally formed at the lower end of the skirt 42 of the cap, at diametrically opposed locations.

Each first cam portion 61 has an arched first cam surface 62 with a centre raised above, or higher than, the flange portion 51 and with a first and second ends 62*a,b* where the arched first cam surface 62 adjoins the top face 51*a* of the flange portion 51. A breakable bridge 70 is present at each end 62*a,b* of the upwardly arched first cam surface 62.

As preferred, and as can be seen for instance in FIG. 12, the bridges 70 in the pair of breakable bridges 70 associated with each of the two first cam portion 61 of the ring member 50 are not arranged symmetrically such that, once the cap is removed and then placed back on the neck in a position 180° rotated relative to the initial molded position, the remains of each of the bridges 70 do not line up. They would do so of the arrangement of the bridges 70 was symmetrical. Due to this arrangement any tampering may be better visible. Of course, embodiments are possible with another arrangement and/or other number of breakable bridges between the lower edge of the skirt of the cap and the ring member 50.

In the illustrated embodiment, each second cam portion 45 comprises an outwardly extending tab 46 that is integrally formed at the lower end of the skirt 42 and is adapted to cooperate with the first cam surface 61. As preferred the cap has two diametrically opposed tabs 46.

In order to enhance grip on the cap and/or to enhance anti-choke properties of the cap 40, the cap has two diametrically opposed, substantially planar wing portions 47 that extend outwardly from the skirt 42 in an imaginary vertical plane through the main axis 16 of the neck 14.

It can be seen that the single pair of first cam portions 61 are located on diametrically opposed locations relative to this imaginary vertical plane through the wing portions 47 of the cap. This is effective in view of injection molding and of strength of the cap and integrated tamper-evident ring member.

It can be seen that at least one pair of hook members 53 and corresponding hook member passages 18 is located on diametrically opposite locations relative to the neck 14 and in the imaginary vertical plane through the wing portions 47 of the cap.

It can be seen that at least one hook member, here as preferred two hook members 53, and corresponding hook member passages 18 are located on diametrically opposed locations relative to the imaginary vertical plane through the wing portions 47 of the cap.

With reference to FIGS. 13-19 a second exemplary embodiment 100 of the closure assembly according to the invention will be described. Herein components and details thereof corresponding to components and details thereof included in the first exemplary embodiment will be denoted with the same reference numeral provided with an accent.

A main difference with the first exemplary embodiment is the shape of the flange portions 21', 51. In the depicted embodiment of FIGS. 13-19 the upper face 21*a'* of the flange portion 21' of on the neck 14' of the article 10' is saddle shaped. This upper face has two diametrically opposed downwardly curved upper face zones 21*a*1'. The bottom face 51*b'* of the ring member flange portion 51' is complementary saddle shaped. As can be seen these flange portions 21', 51' also have their other, bottom or upper, face saddle shaped, so that these flange portions are saddle shaped in form.

As can be seen the breakable bridges are arranged between the saddle shaped flange portion 51' and a correspondingly shaped lower edge 42*c'* of the skirt.

The cap 40' here is, as in the first exemplary embodiment, a quarter-turn snap-on cap that is released from the article 10' by the user turning the cap over about a quarter turn.

The snap-on cap 40' is retained on the neck by means of cooperating snap formations 13', 43'.

A lift effect of the cap 40' upon opening is achieved here by the fact that the saddle shape of the upper face of the flange portion 51' cooperates with the corresponding saddle shape of the lower edge 42*c'* of the skirt 42'. Therefore no additional cam and cam follower arrangement is required.

The ring member 50' here has four hook members 53' that protrude downwardly from the bottom of the flange portion 51'. The flange portion 21' has four respective passages 18'.

The outer contour of the rim portion 25', in this second example, lacks parallel faces. Therefore, as an option, the article is provided with a pair of parallel faces 28 in a region of the neck 14' below the flange portion 21', here between the flange portion and the seal boat 12'.

With reference to FIGS. 20-26 a third example of a closure assembly according to the invention will be discussed. Herein items corresponding to items discussed with herein in conjunction with the first and/or second exemplary embodiment are provided with the same reference numeral with an addition of double quote marks.

The FIG. 20 shows closure assembly 200 comprising an article 10" and comprising a cap 40" provided with an integrated tamper-evident ring member 50".

As can be seen for instance in FIG. 21 the article 10" forms a tubular neck 14" around a product passage, the neck having a main axis and forming a mouth at a top end.

The article further comprises a flange structure 20" which is integrally formed to the neck 14" and comprises one or more flange portions, here a circumferential flange portion, having a top face, a bottom face, and a periphery. As preferred, a peripheral protective rim 25" is integral to and extends upwards from the flange portion at the periphery thereof.

The cap 40" provided with an integrated tamper-evident ring member 50" is adapted to be secured or is secured on said neck of the article by means of an axial securing motion along the main axis.

In these figures, it is illustrated that the cap 40" has an annular top wall 41" having an inner perimeter and an outer perimeter. A downward depending skirt 42" is integral with the outer perimeter. A hollow pin portion 48" depends from the inner perimeter. The hollow pin portion 48" has a circumferential face extending along a length thereof and a closed pin bottom. The hollow pin portion here is open at a top thereof.

The circumferential face of the hollow pin portion 48" and the article 10" have at least one pair of cooperating sealing surfaces such that hollow pin portion 48", in the closed position cap, closes the product passage 15". As preferred, a top seal is established in a top region of the neck 14" between the portion 48" and the interior of the neck 14", e.g. at A in FIG. 27. As preferred, a lower seal is established between a lower end region of the pin portion 48", e.g. at B in FIG. 27. So, preferably, two seals are created at different heights between the pin portion 48" and the article 10".

It is shown that, as preferred, the hollow pin portion 48" extends from the annular top wall downward at least to the level of the tamper-evident ring member, preferably further downward, e.g. to a top horizontal wall of a spout 10" forming the article.

The skirt 42" has an interior side, an exterior side, and a lower edge remote from the top wall structure.

The cap 40" is adapted to be manually removed from the neck of the article by a user to open the product passage. The illustrated cap 40" is a quarter-turn cap.

The tamper-evident ring member 50" is integrally formed to the skirt 42" of the cap and connected to the skirt via one or more breakable bridges 70".

The tamper-evident ring member comprises an annular ring member flange portion 51" that has a top face, a bottom face, an inner face, and an outer face. Multiple hook members 53" are integrally formed to the ring member flange portion, the hook members being distributed in a circumferential direction of the ring member flange portion.

The flange structure 20" on the neck of the article is provided with multiple hook member passages 18", each hook member passage being adapted to receive therein a hook member when the cap 40" with the integrated tamper-evident ring member 50" is axially mounted on the neck by means of an d axial securing motion along the main axis. Herein a hook portion of each hook member snaps onto, here underneath, the flange structure.

The figures also illustrate that the skirt 42" of the cap 40" on the one hand and the flange structure 20" of the article 10" on the other hand have co-operating snap connector formations to provide a snap-on functionality of the cap.

Herein the closure assembly 200 is embodied such that upon first time opening of the closure assembly by removal of the cap 40" by a user the one or more breakable bridges 70" break and the tamper-evident ring member 50" is retained by means of the hook members 53".

The removed cap 40" is later replaceable on the neck 14" by the user, with the co-operating snap connector formations on the skirt of the cap on the one hand and on the flange structure of the article on the other hand releasably latching the cap 40" onto the article.

In the depicted example, the peripheral protective rim portion 25" of the flange structure on the one hand and the exterior side of the skirt 42" of the cap having co-operating snap connector formations. In more detail in this example, the peripheral protective rim 25" of the flange structure is provided with at least one upwardly protruding latch wall portion 26" having a window 27" or recess therein. The exterior side of the skirt 42" is provided with a latching tab 46" that is snapped into said window 27" or recess in the closed position of the cap 40". The tab 46" becomes unsnapped and released from the window 27" or recess when the user removes the cap 40".

As shown, here the outside or outer contour of the protective rim portion 25" provides at least one pair of opposed parallel side faces. As preferred, the two upwardly protruding latch wall portions 26" are erected on parallel parts of the rim portion 25" so that the assembly 200 has relative large parallel surfaces which may be advantageous in view of handling of the article 10" and/or the assembly 200, e.g. in view of guiding and/or gripping the article 10" or the assembly 200.

As will be recognized, the depicted third exemplary embodiment further has:

- at least one first cam portion 61" defining a cam surface, which cam surface is angled with respect to the main axis, which first cam portion is integrally formed on one of the lower edge of the skirt and the flange portion 51" of the tamper-evident ring member, and
- at least one second cam portion 44" defining a cam follower surface adapted to interact with the cam surface of the first cam portion 61" and which second cam portion is integrally formed on the other one of the lower edge of the skirt 42" and the flange portion of the tamper-evident ring member, wherein—upon first time opening of the closure assembly by rotation of the cap 40" relative to the article about the main axis—the first and second cam portions 61", 44" interact in order to cause, practically immediately upon turning the cap, an axial lifting of the cap relative to the neck, so upward, e.g. so that the co-operating snap connector formations disengage due to said lifting and the bridges 70" breaking.

Depending on the design of the first cam portion and the second cam portion the cap may be rotatable about the neck for opening the closure in both directions, so clockwise and counter clockwise, or the design may be such that the cap is rotatable in just one direction, e.g. only clockwise.

In embodiments the tab 46" on the exterior of the skirt provides both the snap-on functionality for the cap 40" and serves as a part of the second cam portion, said dual functionality tab 46" being adapted to cooperate—once released from the respective window 27" or recess as the user turns the cap 40" for opening—with the first cam surface.

It is illustrated that the cap 40" has two diametrically opposed tabs 46" and that the peripheral protective rim 25" is provided with two upwardly protruding latch wall portions 26", each of them having a window 27" or recess therein. Each of said pair of tabs 46" is snapped into a corresponding window 27" or recess in the closed position of the cap.

In FIG. 29 the closure assembly 300 is generally the same as closure assembly 200. The difference is that the cap 40'" now has two diametrically opposed, wing portions 47'" that extend outwardly from the skirt in an imaginary vertical plane through the main axis of the neck. This is done in order to enhance grip on the cap and/or to enhance anti-choke properties of the cap.

With reference to FIGS. 30-35 a fifth example of a closure assembly according to the invention will be discussed. Herein items corresponding to items discussed with herein in conjunction with the first and/or second exemplary embodiment are provided with the same reference numeral increased with 400, so reference numeral 1 in FIG. 1 is numeral 401 in these FIGS. 30-35.

The FIG. 30 shows closure assembly 401 comprising an article 410 and comprising a cap 440 provided with an integrated tamper-evident ring member 450.

As can be seen for instance in FIG. 32 the article 410 forms a tubular neck 414 around a product passage, the neck having a main axis and forming a mouth at a top end.

The article further comprises a flange structure 420 which is integrally formed to the neck 414 and comprises one or more flange portions, here a circumferential flange portion, having a top face, a bottom face, and a periphery.

As shown the article has the flange structure 420 as a top flange structure, and further has a lower or second flange structure 422 below said top or first flange structure 420.

As preferred, a peripheral protective rim 425 is integral to and extends upwards from the top flange portion 420 at the periphery thereof.

Between the two vertically spaced flange structures 420, 422 the article 410 forms two parallel vertical faces 423, that define together with the flange structures 420, 422 a guidance and handling functionality for the spout, e.g. when sliding the spout between parallel guide rails.

The cap 440 provided with an integrated tamper-evident ring member 450 is adapted to be secured or is secured on said neck of the article by means of an axial securing motion along the main axis.

In these figures it is illustrated that the cap 440 has a top wall 441 with a W-seal arrangement protruding into the neck 414, e.g. as shown in FIG. 6. Herein the W-seal arrangement comprises a downward projecting bulbous and annular top wall section around a central raised top wall section. A top seal is established in a top region of the neck 414 between the W-seal arrangement and the interior of the neck 414.

The skirt 442 has an interior side, an exterior side, and a lower edge remote from the top wall structure.

The cap 440 is adapted to be manually removed from the neck of the article by a user to open the product passage. The illustrated cap 440 is a quarter-turn cap.

The tamper-evident ring member 450 is integrally formed to the skirt 442 of the cap and connected to the skirt via one or more breakable bridges 470.

The tamper-evident ring member comprises an annular ring member flange portion 451 that has a top face, a bottom face, an inner face, and an outer face. Multiple hook members 453 are integrally formed to the ring member flange portion, the hook members being distributed in a circumferential direction of the ring member flange portion.

The flange structure 420 on the neck of the article is provided with multiple hook member passages 418, each hook member passage being adapted to receive therein a hook member when the cap 440 with the integrated tamper-evident ring member 450 is axially mounted on the neck by means of an d axial securing motion along the main axis. Herein a hook portion of each hook member snaps onto, here underneath, the flange structure.

The figures also illustrate that the skirt 442 on the one hand and the neck 414 of the article 410 on the other hand have co-operating snap connector formations to provide a snap-on functionality of the cap.

Herein the closure assembly 400 is embodied such that upon first time opening of the closure assembly by removal of the cap 440 by a user the one or more breakable bridges 470 break and the tamper-evident ring member 450 is retained by means of the hook members 453.

The removed cap 440 is later replaceable on the neck 414 by the user, with the co-operating snap connector formations on the skirt of the cap on the one hand and on the neck of the article on the other hand releasably latching the cap 440 onto the article.

The cap 440 has two diametrically opposed, wing portions 447 that extend outwardly from the skirt 442 in an imaginary vertical plane through the main axis of the neck 414. This is done in order to enhance grip on the cap and/or to enhance anti-choke properties of the cap.

As will be recognized, the depicted fifth exemplary embodiment further has:

at least one first cam portion 461 defining a cam surface, which cam surface is angled with respect to the main axis, which first cam portion is integrally formed on one of the lower edge of the skirt and the flange portion 451 of the tamper-evident ring member, and at least one second cam portion 444 defining a cam follower surface adapted to interact with the cam surface of the first cam portion 461 and which second cam portion is integrally formed on the other one of the lower edge of the skirt 442 and the flange portion of the tamper-evident ring member, wherein—upon first time opening of the closure assembly by rotation of the cap 440 relative to the article about the main axis—the first and second cam portions 461, 444 interact in order to cause, practically immediately upon turning the cap, an axial lifting of the cap relative to the neck, so upward, e.g. so that the co-operating snap connector formations disengage due to said lifting and the bridges 470 breaking.

Depending on the design of the first cam portion and the second cam portion the cap may be rotatable about the neck for opening the closure in both directions, so clockwise and counter clockwise, or the design may be such that the cap is rotatable in just one direction, e.g. only clockwise.

In FIG. 35 the closure assembly 401' is generally the same as closure assembly 401. The difference is that the cap 440' does not have a W-seal arrangement, e.g. just sealing on the exterior of the neck 414, e.g. in proximity of the top thereof, by contact with a sealing surface on the inside of the skirt 442. The wings 447 are joined by a vertical panel portion 447*a* extending over the top wall 441 of the cap.

The invention claimed is:

1. A closure assembly comprising an article (10,10',10"; 410) and comprising a cap (40,40',40",40'";440) provided with an integrated tamper-evident ring member (50,50',50", 450), wherein:

the article (10) is made of a plastic material and forms a tubular neck (14) around a product passage (15) in said article, said neck having a main axis (16) and forming a mouth (17) at a top end of said product passage (15), wherein the article (10) further comprises a circumferential flange structure (20) which comprises an annular flange portion that is integrally formed to the neck and extends around the neck (14), which flange portion has a top face (21*a*), a bottom face (21*b*), and a periphery, wherein the flange structure further comprises a peripheral protective rim portion (25) that is integral to and extends upwards from the flange portion at the periphery thereof, so that the top face of the flange portion (21) and the protective rim portion (25) define an annular recess (30) around the neck (14), the cap (40) provided with the integrated tamper-evident ring member (50) is made of a plastic material and is adapted to be secured or is secured on said neck (14) of the article by means of an axial securing motion along the main axis (16), wherein the cap (40) comprises a top wall structure (41) and a downward depending skirt (42), said skirt having an interior side (42*a*), an exterior side (42*b*), and a lower edge (42*c*) remote from the top wall structure, wherein the cap is adapted to seal the product passage (15) in a closed position of the cap on said neck, and wherein the cap is adapted to be manually removed from the neck (14) of the article by a user to open the product passage, wherein the tamper-evident ring member (50) is integrally formed to the lower edge of the skirt (42) of the cap (40) and is connected to said lower edge via one or more breakable bridges (70), wherein the tamper-evident ring member (50) comprises an annular ring member flange portion (51) that has a top face (51*a*), a bottom face (51*b*), an inner face (52*a*), and an outer face (52*b*), wherein multiple hook members (53) are integrally formed to the bottom of the ring member flange portion (51), the hook members being distributed in a circumferential direction of the ring member flange portion (51), wherein each hook member (53) comprises a leg (54) having an upper end integral with the ring member flange portion (51) and protruding downward from the ring member flange portion, wherein each hook member comprises a hook portion (55) at the lower free end of the leg, wherein the annular flange portion (21) on the neck (14) of the article is provided with multiple hook member passages (18) that each extend between the top face (21*a*) and the bottom face (21*b*) through said annular flange portion (21), each hook member passage (18) being adapted to receive a hook member (53) when the cap (40) with the integrated tamper-evident ring member (50) is axially mounted on the neck (14) by means of said axial securing motion along the main axis (16), wherein the hook portion (55) of each hook member (53) engages underneath the bottom face (21*b*) of the annular flange portion (21) on the neck of the article, wherein the periphery of the annular flange portion (51) of the ring member (50) is shaped to fit within the protective rim portion (25) as the annular flange portion (51) is at least partially inserted in said annular recess (30) upon said axially mounting of the cap (40) with the integrated tamper-evident ring member (50) on the neck, wherein the peripheral protective rim portion (25) is adapted to obstruct lateral access from outside to the interface between the top face (21*a*) of the flange portion (21) of the article (10) and the bottom face (51*b*) of the flange portion (51) of the ring member (50), and wherein the closure assembly is embodied such that upon first time opening of the closure assembly by removal of the cap (40) by a user the one or more breakable bridges (70) break and the ring member (50) is retained in the recess (30) of the article by means of the hook members (53).

2. The closure assembly according to claim 1, wherein the protective rim portion (25) is devoid of openings therein.

3. The closure assembly according to claim 1, wherein the protective rim portion (25) has a height such that in the secured position of the cap provided with the integrated tamper-evident ring member (50) an outer annular zone of the top face of the flange portion (51) thereof does not protrude above the protective rim portion (25).

4. The closure assembly according to claim 1, wherein the hook members passages (18) are located directly adjoining the neck (14) and/or wherein the legs (54) of the hook members each have an inner leg face (54*a*), said inner leg face adjoining the inner face (52*a*) of the flange portion (51) of the ring member.

5. The closure assembly according to claim 1, wherein the leg of at least one hook member has an inner bevel face (54*b*) at the lower end thereof, and wherein the neck (14) is integrally formed with a corresponding bevel faced boss (19) at a location below the corresponding hook member passage (18), such that upon axially mounting the cap (40) with the integrated tamper-evident ring member (50) on the neck by means of said axial securing motion along the main axis (16), the bevelled face of the boss (19) contacts the inner bevel face (54*b*) of the leg and thereby assists in keeping the hook portion (55) of the hook member (53) engaged underneath the bottom face (21*b*) of the annular flange portion on the neck of the article.

6. The closure assembly according to claim 1, wherein the periphery of the annular flange portion (51) of the ring member and of the protective rim portion (25) are shaped non-circular.

7. The closure assembly according to claim 1, wherein the outside of the protective rim portion (25) provides at least one pair of opposed parallel side faces.

8. The closure assembly according to claim 1, wherein the upper face (21*a*) of the flange portion (21) on the neck of the article is planar, and wherein the bottom face (51*b*) of the ring member flange portion (51) is planar.

9. The closure assembly according to claim 1, wherein the closure assembly comprises a snap-on type cap (40) providing in use of the closure assembly a snap-on functionality.

10. The closure assembly according to claim 9, wherein the exterior side of the neck of the article and the interior side of the skirt of the cap have co-operating snap connector formations (13,43) to provide the snap-on functionality.

11. The closure assembly according to claim 9, wherein the skirt of the cap on the one hand and the circumferential flange structure of the article have co-operating snap connector formations to provide the snap-on functionality.

12. The closure assembly according to claim 1, wherein the closure assembly comprises:

at least one first cam portion (61) defining a cam surface (62), which cam surface (62) is angled with respect to the main axis (16), which first cam portion (61) is integrally formed on one of the lower edge of the skirt and the flange portion (51) of the tamper-evident ring member (50), and at least one second cam portion (44) defining a cam follower surface (45) adapted to interact with the cam surface (62) of the first cam portion (61) and which second cam portion is integrally formed on the other one of the lower edge of the skirt (42) and the flange portion of the tamper-evident ring member, wherein, upon first time opening of the closure assembly by rotation of the cap (40) relative to the article (10) about the main axis (16), the first and second cam portions interact in order to cause axial lifting of the cap relative to the neck (14).

13. The closure assembly according to claim 12, wherein a pair of first cam portions (61) is integrally formed at the top face of the ring member flange portion, at diametrically opposed locations, and wherein a pair of second cam portions (44) is integrally formed at the lower end of the skirt (42), at diametrically opposed locations.

14. The closure assembly according to claim 12 or 13, wherein the first cam portion has an arched first cam surface (62) with a centre raised above the flange portion and with a first and second ends (62*a,b*) where the arched first cam surface adjoins the top face (51*a*) of the flange portion.

15. The closure assembly according to claim 12, wherein the second cam portion (44) comprises an outwardly extending tab (46) integrally formed at the lower end of the skirt and adapted to cooperate with the first cam surface (62).

16. The closure assembly according to claim 1, wherein, in order to enhance grip on the cap and/or to enhance anti-choke properties of the cap, the cap has two diametrically opposed, wing portions (47) that extend outwardly from the skirt in an imaginary vertical plane through the main axis (16) of the neck.

17. The closure assembly according to claim 13, wherein, in order to enhance grip on the cap and/or to enhance anti-choke properties of the cap, the cap has two diametrically opposed, wing portions (47) that extend outwardly from the skirt in an imaginary vertical plane through the main axis (16) of the neck, and wherein the cam portions of the pair of first cam portions (61) are located on diametrically opposed locations relative to said imaginary vertical plane through the wing portions (47) of the cap.

18. The closure assembly according to claim 1, wherein the article (10;10';10") is a spout having a lower connector portion (12,12',12") adapted to be secured or secured between opposed film walls of a collapsible pouch container or having a lower circumferential flange or plate portion to be secured or secured onto a panel of a container.

19. A container provided with a closure assembly (1;100;200;300;401) according to claim 1.

20. A method for manufacturing and filling a container, comprising the steps of:

providing a container having the article (10) of claim 1 thereon without the cap and integrated tamper-evident ring member, filling the container, securing the cap (40) and integrated tamper-evident ring member (50) of claim 1 onto the neck (14) of the article (10) by means of an axial securing motion along the main axis (16) such that the cap seals the product passage, wherein the hook members (53) enter into and through the respective hook member passages (18) and their hook portions (55) engage underneath the bottom face (21*b*) of the annular flange portion (21) on the neck, and wherein the flange portion (51) of the ring member is at least partially inserted in the annular recess (30).

* * * * *